US007111650B2

(12) United States Patent
Few

(10) Patent No.: US 7,111,650 B2
(45) Date of Patent: Sep. 26, 2006

(54) RADIATOR FLUID EXCHANGING APPARATUS

(75) Inventor: Jeffrey P. Few, Elkhart, IN (US)

(73) Assignee: Norco Industries, Inc., Compton, CA (US)

( * ) Notice: Subject to any disclaimer, the term of this patent is extended or adjusted under 35 U.S.C. 154(b) by 95 days.

(21) Appl. No.: 10/761,875

(22) Filed: Jan. 21, 2004

(65) Prior Publication Data

US 2005/0067048 A1 Mar. 31, 2005

Related U.S. Application Data

(63) Continuation-in-part of application No. 29/190,860, filed on Sep. 26, 2003, now Pat. No. Des. 497,624.

(51) Int. Cl.
*B65B 1/04* (2006.01)
*B67C 3/02* (2006.01)

(52) U.S. Cl. ..... 141/98; 141/65; 141/59; 184/1.5

(58) Field of Classification Search ..... 141/65, 141/59, 98; 184/1.5
See application file for complete search history.

(56) References Cited

U.S. PATENT DOCUMENTS

| | | | | |
|---|---|---|---|---|
| 3,513,941 | A | 5/1970 | Becnel | |
| 4,109,703 | A | 8/1978 | Babish et al. | |
| 4,366,069 | A | 12/1982 | Dudrey et al. | |
| 5,021,152 | A | 6/1991 | Filowitz et al. | |
| 5,273,085 | A | 12/1993 | Edwards et al. | |
| 5,318,080 | A | 6/1994 | Viken | |
| 5,318,700 | A | 6/1994 | Dixon et al. | |
| 5,390,636 | A | 2/1995 | Baylor et al. | |
| 5,427,202 | A | 6/1995 | Behring et al. | |
| 5,482,062 | A | 1/1996 | Chen | |
| 5,586,583 | A | 12/1996 | Edwards et al. | |
| 5,743,357 | A * | 4/1998 | Few | 184/1.5 |
| 5,853,068 | A | 12/1998 | Dixon et al. | |
| RE36,650 | E * | 4/2000 | Viken | 184/1.5 |
| 6,062,275 | A | 5/2000 | Rome et al. | |
| 6,071,355 | A * | 6/2000 | Suratt | 134/21 |
| 6,073,666 | A * | 6/2000 | Clark, II | 141/65 |
| 6,213,175 | B1 | 4/2001 | Rome et al. | |
| 6,247,509 | B1 | 6/2001 | Rome et al. | |
| 6,360,791 | B1 | 3/2002 | Rome et al. | |
| 6,382,271 | B1 | 5/2002 | Betancourt et al. | |
| 6,435,223 | B1 | 8/2002 | Betancourt et al. | |
| 6,474,370 | B1 | 11/2002 | Betancourt et al. | |
| 6,481,469 | B1 * | 11/2002 | Erwin et al. | 141/95 |
| 6,539,958 | B1 | 4/2003 | Betancourt et al. | |
| RE38,232 | E | 8/2003 | Rome et al. | |
| 6,830,082 | B1 * | 12/2004 | Few | 141/65 |

(Continued)

*Primary Examiner*—Khoa D. Huynh
(74) *Attorney, Agent, or Firm*—Fulwider Patton LLP

(57) ABSTRACT

A radiator fluid exchanging apparatus including at least one fluid supply tank and a pressure vessel with a pressure generator, the tank and the vessel each including a multi-directional supply coupling in communication with first and second selectively operable fluid control manifolds, one manifold being in communication with a pump for supplying fluid from the supply tank to an influent port of an engine cooling system to be serviced, the other manifold being interposed between the pressure vessel and an effluent port of the engine cooling system, when coupled thereto, for drawing waste fluid into the vessel and resupplying fluid from the fluid supply tank under negative pressure to the engine cooling system as determined by the selective operation of the control manifolds and actuation of the pump and pressure generator.

21 Claims, 13 Drawing Sheets

U.S. PATENT DOCUMENTS

| | | | | |
|---|---|---|---|---|
| 6,886,606 | B1 * | 5/2005 | Few et al. | 141/65 |
| 6,896,014 | B1 * | 5/2005 | Bedi | 141/65 |
| 2004/0065347 | A1 * | 4/2004 | Awad | 134/18 |
| 2004/0079442 | A1 * | 4/2004 | Flynn | 141/98 |
| 2004/0103955 | A1 * | 6/2004 | Awad | 141/98 |
| 2005/0166991 | A1 * | 8/2005 | Awad | 141/1 |
| 2005/0205119 | A1 * | 9/2005 | Awad | 134/169 A |

* cited by examiner

FIG. 7
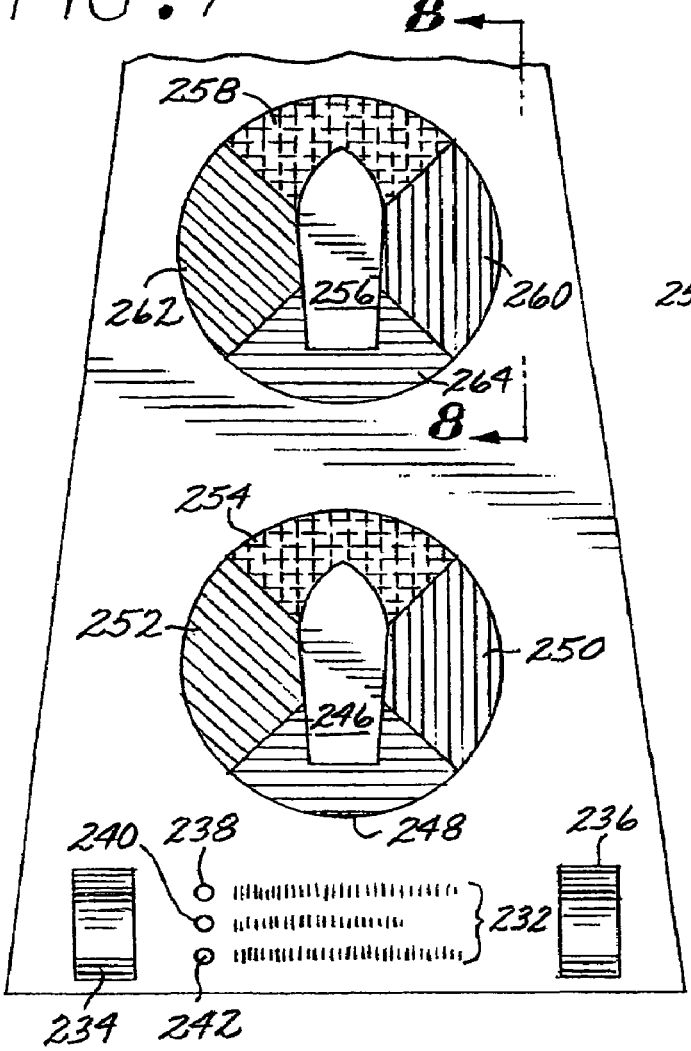
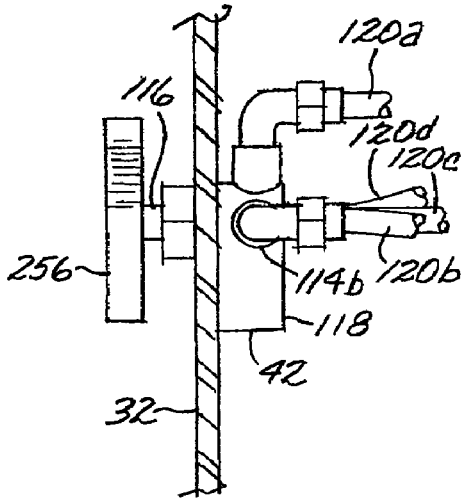
FIG. 8
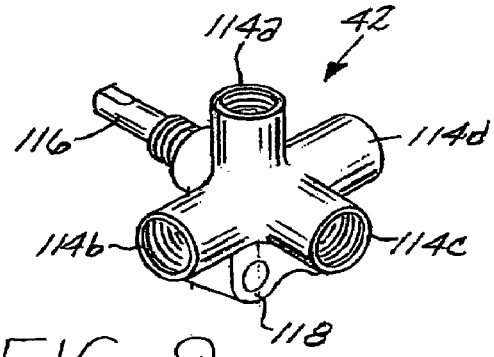
FIG. 9
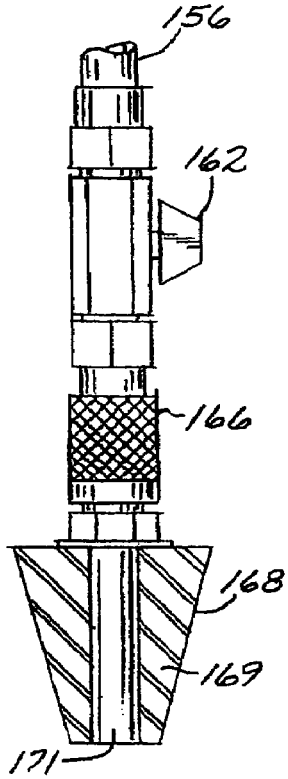
FIG. 10

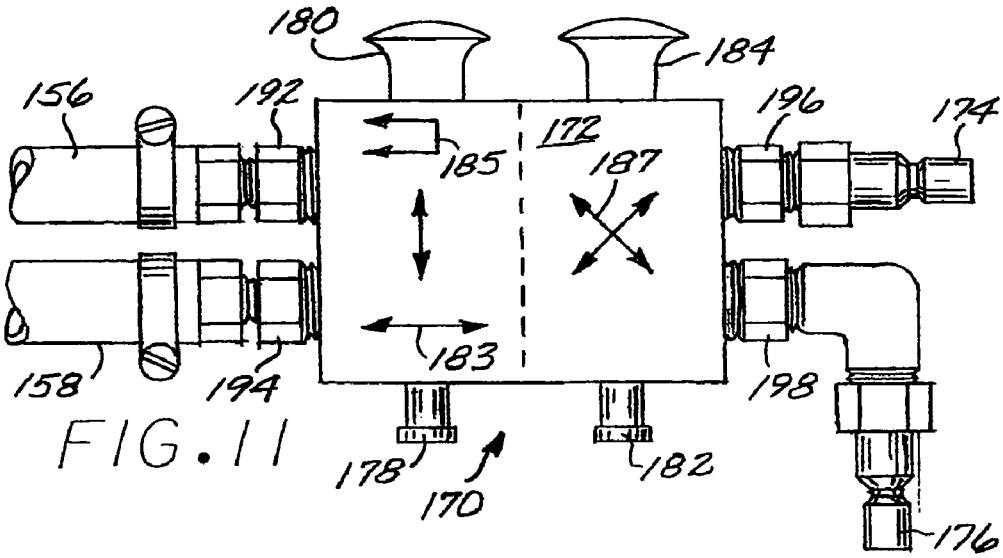
FIG. 11
FIG. 12
(PRIOR ART)
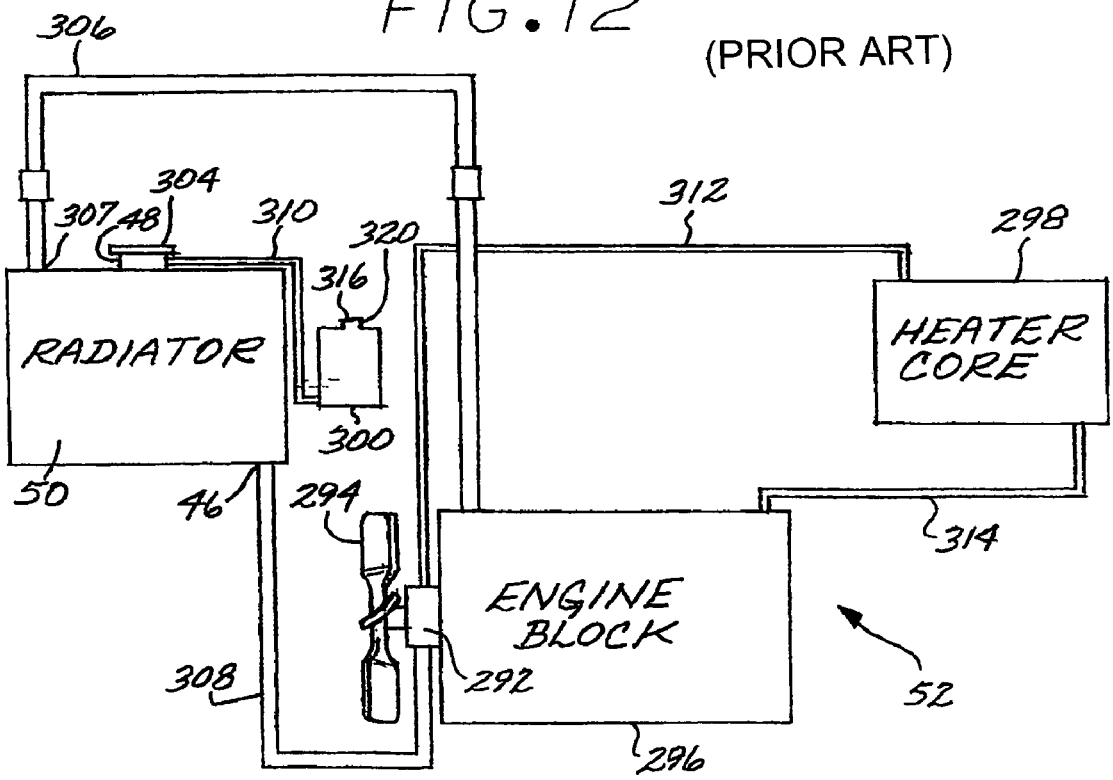

RADIATOR FLUID EXCHANGING APPARATUS

This is a continuation-in-part application of co-pending U.S. Ser. No. 29/190,860, now U.S. Pat. No. D497,624, entitled Radiator Fluid Exchanger Cabinet, filed on Sep. 26, 2003, which is incorporated herein in its entirety.

BACKGROUND OF THE INVENTION

1. Field of the Invention

The present invention relates to the field of vehicle maintenance, and more specifically, to servicing vehicle cooling fluid systems.

2. Description of Related Art

The engine cooling system is but one vehicle system that requires routine maintenance to extend the longevity of the system and the vehicle. A typical engine cooling system includes a radiator connected to a water pump via an effluent line which is in turn connected to a heater core and an engine block. An influent line completes the fluid loop by connecting the radiator inlet port to the outlet port of the engine block. Depending on the direction the water is pumped, this loop may be reversed. The radiator also includes a radiator pressure cap coupled to an overflow bottle via an overflow conduit.

Typically, as coolant evaporates or breaks down over time, a relatively simple maintenance routine involves the periodic monitoring of the radiator fluid level by visually examining the fluid level in relation to a fill line on the overflow bottle connected to the radiator. If the level is low, the bottle may be refilled with water, anti-freeze, or a pre-mix fluid by removing the cap to the overflow bottle and pouring in the desired fluid until the level is again at the fill line. Related to this, when the engine is sufficiently cooled, the fluid level in the radiator itself may be checked by removing the radiator cap to visually check the level of fluid in the radiator. The fluid may be topped off by pouring the proper fluid directly into the radiator through its fill neck.

As the efficiency of heat transfer deteriorates with time, as from broken down aged coolant, the risk of overheating and damaging the engine is increased. Thus, in addition to these routine topping off procedures, most dealers or service technicians recommend changing the engine coolant completely every 15,000 to 20,000 miles. Of course, this may vary depending on the vehicle. In the interim, it may also be advisable to exchange a significant amount of fluid to maintain the vehicle in top form and extend the life of the vehicle. Thus, in some instances, it may be necessary to exchange some or all of the old fluid in the radiator with new fluid or flush the radiator completely.

One early method of replacing old coolant required the service technician to disconnect the lower effluent hose from the bottom of the radiator and allow the free end to drain into a collection tank. Then it was a matter of routine for the technician to insert a flushing hose into the fill neck of the radiator to flush the system until the fluid exiting the bottom of the radiator ran clear. Often, the fluid was drained directly into the street drain or public sewage system leading to undesirable environmental impacts. Once the flushing was accomplished the lower hose was reconnected and the radiator refilled with the recommend type of anti-freeze and water or a pre-mix until the fill line in the radiator was reached. The overflow bottle was then also filled. However, this fluid replacement method wasted a considerable amount of water to completely flush the radiator. In addition, this procedure, being dependent on the pressure of the flushing hose and gravity fluid flow, took a considerable amount of time to flush the contents of the radiator and did not result in satisfactorily flushing the entire cooling system.

To improve the speed of these fluid exchange procedures, a number of machines were developed to remove and replace the coolant within the radiator. Such machines introduced pump assisted fill or drain procedures to force fluid through the vehicle's engine cooling system but with the engine running so the thermostat remained open. One such exemplary machine may be found in U.S. Pat. No. 5,853,068 to Dixon et al. This machine includes a single pump used to draw fluid from a fresh fluid reservoir into the engine cooling system while the vehicle engine is running and the water pump is forcing old fluid out of the engine cooling system into a waste collection tank. An overpressure switch is responsive to pressure build-up beyond pre-set tolerable limits, such as from a defective thermostat. However, such system has a drawback as a significant amount of new fluid must be introduced into the system to ensure the air is completely forced out of the engine coolant loop.

Another example of prior efforts is found in U.S. Pat. No. 5,390,636 to Baylor et al. This type of machine uses compressed air to force supply fluid into the engine cooling system to displace the old fluid. However, residual amounts of compressed air often become trapped the engine cooling system. In recognition of this problem a valve is closed in response to predetermined coolant level drop in a supply tank to relieve air pressurization of the tank and interrupting coolant flow. Thus, the system is controlled by deactivating air flow based on a measured quantity of coolant fluid delivered from the supply tank. Either a low level float in the supply tank or a relay connected to a solenoid is responsive to close a valve when a low level switch triggers the relay to cease introduction of additional pressurized air. However, a failure in the switching system or valve closure would result in introducing air into the engine coolant system. Also, according to this patent, the air is bled from the system if necessary, indicating that some air may be trapped during the process.

The problem with leaving air in the vehicle cooling system is that a dangerous condition can arise if too much air remains. Air in the system can expand when heated and blow the hoses or otherwise weaken the hoses thereby shortening the lifespan of the cooling system of the vehicle. In addition, during this procedure, the engine is also running to maintain the thermostats in an open state requiring the service technician to perform additional safety procedures.

What is needed and heretofore unavailable is a radiator fluid exchanging apparatus configured to perform a variety of servicing procedures including an interim exchange using vacuum assisted fluid control and complete exchange with the engine in an off condition along with providing the versatility of collecting fluid for waste control purposes while reducing the likelihood of introducing air into the vehicle cooling system.

SUMMARY OF THE INVENTION

In accordance with an embodiment of the present invention, a radiator fluid exchanging apparatus for servicing a vehicular engine coolant system having an influent port and effluent port such as commonly found in a radiator is described herein. Such fluid exchanging apparatus generally includes at least one fluid supply tank with a multi-directional supply coupling for routing fluid between the supply tank and a first selectively controllable manifold in communication with a pump for supplying fluid to an influent port of an engine cooling system or routing fluid to a second selectively controllable manifold that may be interposed between the effluent port and a pressure vessel including a pressure generator for drawing fluid from the effluent port into said pressure vessel or resupplying fluid from the fluid supply tank under negative pressure.

Another feature of one embodiment of the present invention is the provision of a remove and fill conduit that may be coupled between the remove and fill control manifold and effluent port of the radiator.

Yet another feature in one embodiment of the present invention is the provision of a fluid supply conduit that may be coupled between a pump and an influent port of the radiator.

In other embodiments of the present invention, the remove and fill conduit and fluid supply conduit include free ends with valves and quick disconnect assemblies for coupling to a variety of adapters.

In yet another embodiment of the present invention an auxiliary fluid supply tank in communication with both fluid control manifolds is provided as an alterative fluid supply source.

Another feature of the present invention is the housing of the primary and auxiliary fluid supply tanks, the pressure vessel and pressure generator, pump and fluid control manifolds in a convenient wheeled cabinet.

In accordance with another embodiment of the present invention, a main board is in electrical communication with at least one sensor in said supply tank or pressure vessel and is responsive to the sensor generated fluid level signal to generate a status indicator.

Yet another embodiment of the present invention includes of a delay circuit in communication with the main board and an upper level fluid sensor in the pressure vessel whereby a high level fluid status indicator is not generated until an upper level fluid sensor generates a high level fluid signal for over a predetermined period of time.

In a further embodiment of the present invention, the delay circuit may be adjustable via an adjustable capacitive element in said circuit.

Also described herein is a method for removing and replacing a fluid from a fluid reservoir such as a radiator of an engine cooling system by selectively routing fluid to and from the radiator under negative pressure generated by the pressure generator via a selectively operable fluid control manifold.

Further described herein is a method for performing a pressure test on the engine cooling system using the radiator fluid exchanging apparatus.

Other aspects of the present invention will become apparent with further reference to the following drawings and specification.

BRIEF DESCRIPTION OF THE DRAWINGS

FIG. 7 is a front partial sectional view of an exemplary control panel, in enlarged scale, included in the radiator servicing apparatus shown in FIG. 1;

FIG. 8 is a partial sectional view, in enlarged scale, taken along lines 8—8 of FIG. 7 and illustrating an exemplary upper manifold valve and conduit connections;

FIG. 9 is a perspective view, in enlarged scale of an exemplary manifold valve of FIG. 8 with the hoses and dial removed;

FIG. 10 is a partial sectional view of one end of a servicing hose with a cone adapter;

FIG. 11 is a partial side view of an alternative servicing hose adapter for coupling to a pair of servicing hoses of the radiator fluid exchanging apparatus of FIG. 1;

FIG. 12 is an exemplary schematic of a conventional engine cooling system to be serviced by the radiator fluid exchanging apparatus of FIG. 1;

DETAILED DESCRIPTION OF THE PREFERRED EMBODIMENTS

Figure 1:
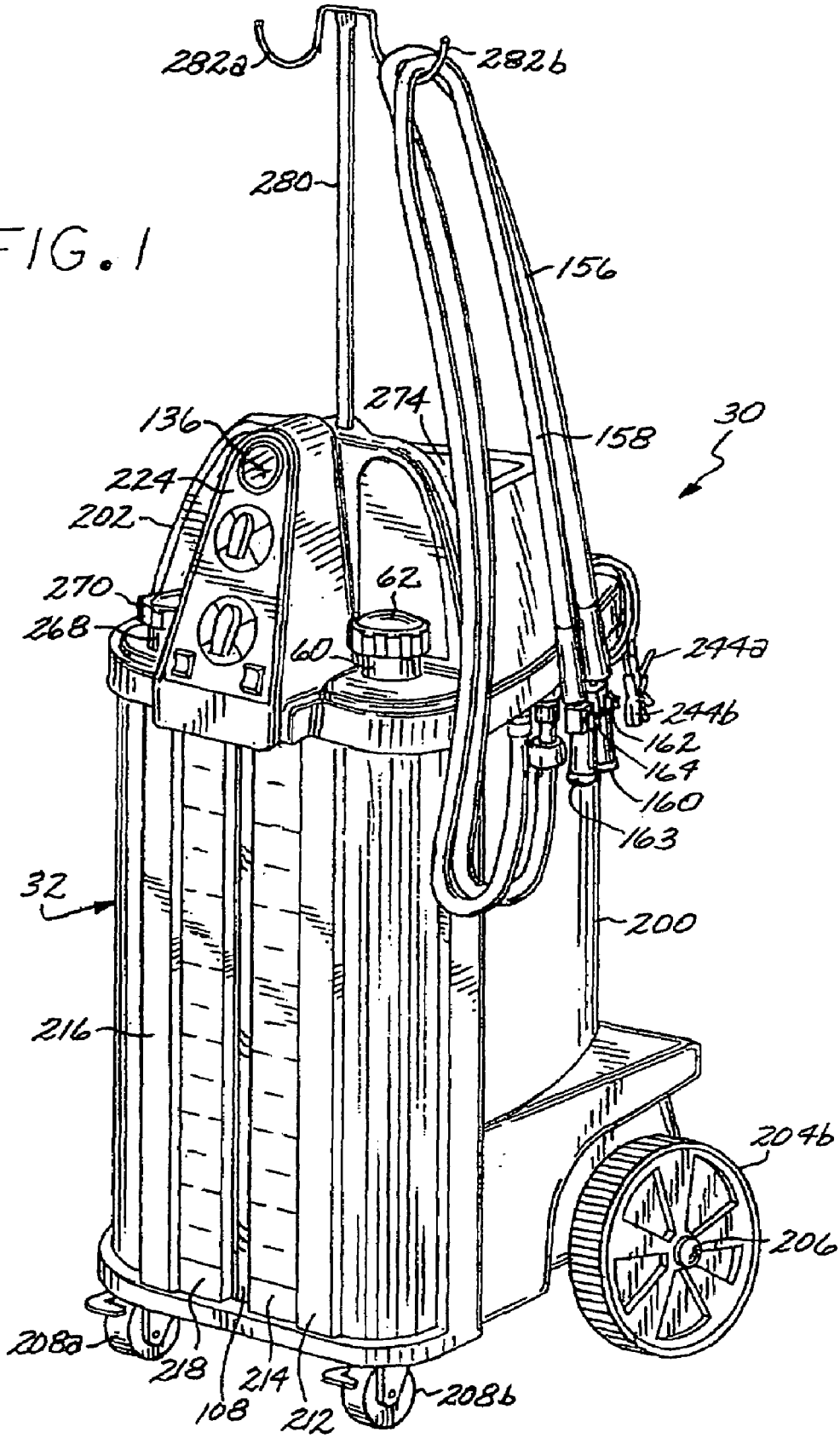
FIG. 1 is a right front perspective view of a preferred embodiment of the radiator fluid exchanging apparatus of the present invention.

Referring now to FIGS. 1, 5–6, and 17, an exemplary embodiment of a radiator fluid exchanging apparatus, generally designated 30, of the present invention is illustrated. Such exemplary radiator fluid servicing apparatus is incorporated in a convenient, portable wheeled cabinet 32 housing a primary fluid supply tank 34 and a pressure vessel 36 with a vacuum generator 38 for generating negative pressure in the pressure vessel and a pump 40 with the tank, vessel, and pump in fluid communication with one another through a remove and fill control manifold 42 and a flush control manifold 44 which may be coupled to influent and effluent ports of a radiator 50 in an engine cooling system for performing a variety of servicing procedures on the cooling system. Most, of these components are included in a fluid transportation subsystem that may be used in conjunction with an electrical feedback and control system as will be described in more detail below.

With continued reference to FIGS. 1, 5–6, and 17, the fluid transportation subsystem and components for routing fluid between the engine cooling system and the radiator fluid exchanging apparatus 30 will now be described. The fluid transportation system includes the primary fluid supply tank 34 as a source of primary supply fluid 35, an auxiliary fluid supply tank 56 as an alternate source of supply fluid 37 as, for example, a radiator fluid with a chemical additive such as a decalcifier, and the pressure vessel 36 for collecting waste fluid 39. The primary fill tank 34 is generally cylindrically shaped and includes an upper surface 58 and an opposing bottom surface 70. The upper surface 58 has an upwardly projecting hollow fill neck 60 with an exterior threaded region for receiving a complementally threaded cap 62 (FIG. 1). With the cap removed, the user may pour fluid directly into the primary fill tank 34 through the fill neck.

Also projecting from the upper surface 58 of the primary fluid supply tank 34 is a T-shaped primary fluid supply coupling 64 with multi-directional flow construction. This coupling includes a first supply outlet 65 and an opposing second supply outlet 67 and is screwed onto a hollow suction tube 66 extending into the interior of the primary fluid supply tank. An open bottom end 68 of the suction tube is disposed near the bottom surface 70 of the primary fluid supply tank 34. The supply outlets 65 and 67 and the inlet 68 of the suction tube are typically in fluid communication with one another when in use.

Figure 14:
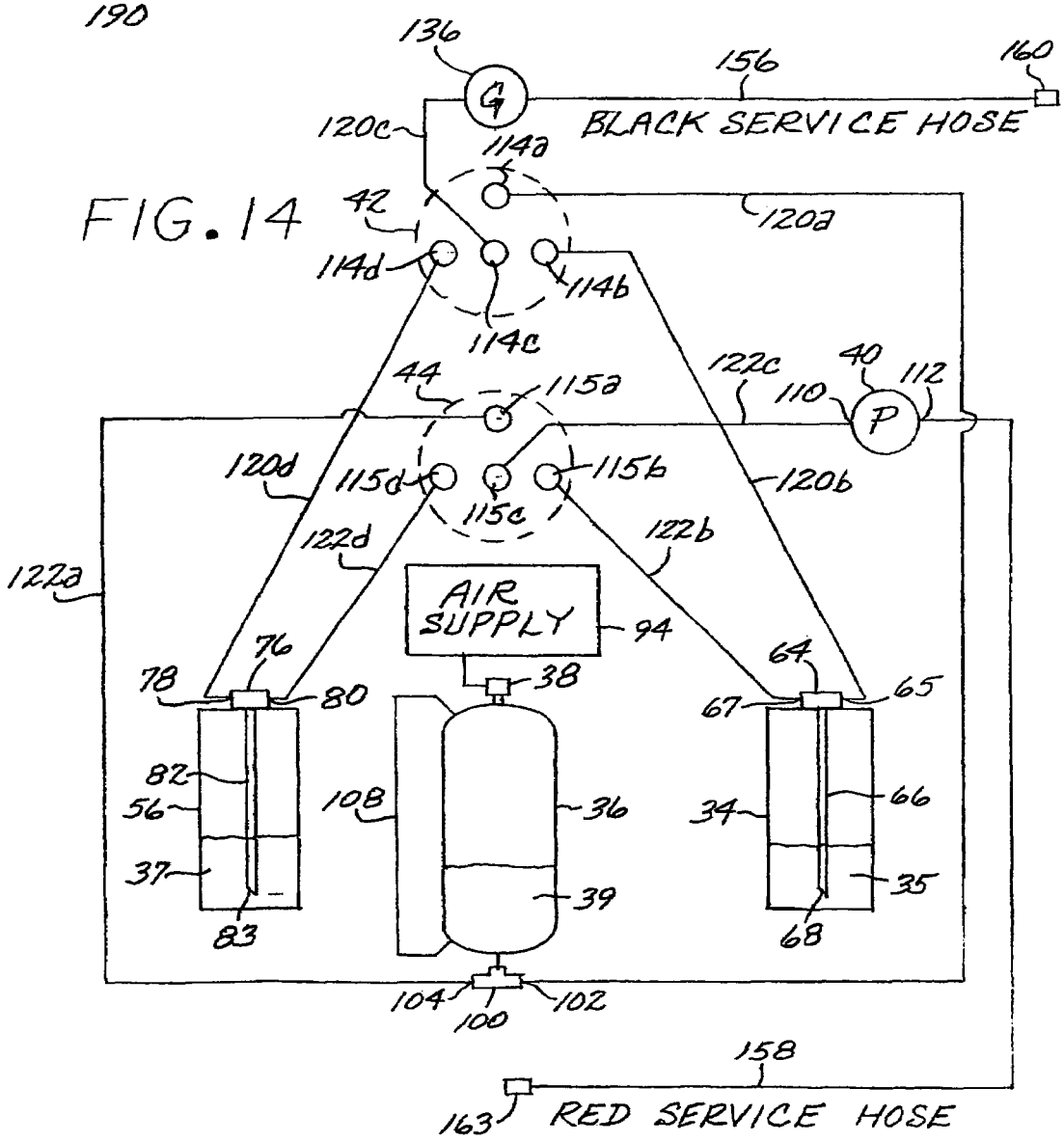
FIG. 14 is a schematic of an exemplary plumbing circuit of the radiator fluid exchanging apparatus of FIG. 1.
Figure 17:
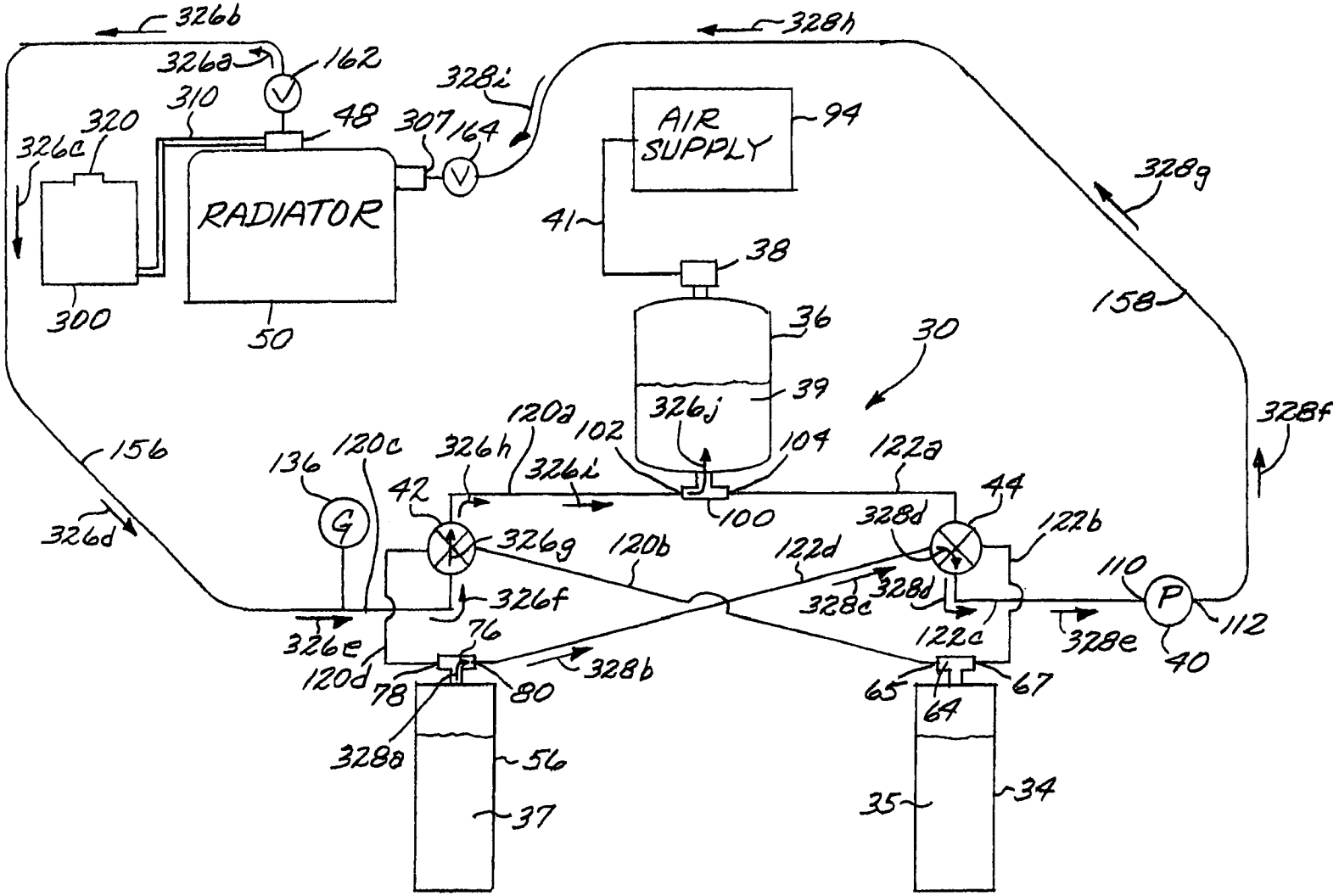
FIG. 17 is a schematic of an exemplary plumbing circuit for performing a flush exchange procedure using the radiator fluid exchanging apparatus of FIG. 1.

Referring to FIGS. 1, 14, and 17, the auxiliary fluid supply tank 56 is constructed in a similar manner to the primary fluid supply tank 34 and includes a T-shaped auxiliary fluid supply coupling 76 also with multi-directional flow construction including an auxiliary first supply outlet 78, an auxiliary second supply outlet 80, an inlet tube 82 with an open bottom end 83. The auxiliary tank also includes a hollow, externally threaded fill neck 268 and cap 270.

The primary and auxiliary fluid supply tanks 34 and 56, respectively, are preferably manufactured of a lightweight but durable plastic material. The plastic is also preferably constructed with a transparent or translucent section projecting vertically throughout the height of the tank to enable a service technician to view the fluid levels in the respective tank. Each primary and auxiliary fluid supply tank preferably has a capacity of about 24–28 quarts to enable a series of sequential servicing procedures without undue repetitive refilling of the supply tanks prior to each procedure.

Referring back to FIGS. 5–6 and 17, the waste fluid collection tank 36 is preferably manufactured from a metallic material such as steel or other suitable material and is constructed to function as a pressure vessel. The waste tank 36 is also generally cylindrically shaped and includes a rounded outwardly bowed top surface 86 and an opposing rounded outwardly bowed bottom surface 88. Sitting atop the top surface 86 of the waste tank 36 is the pressure generator 38 that includes a hose nipple for attaching to an air source 94 capable of preferably generating at least 115 psi air pressure, such as that commonly provided in most service stations as shop air, via an air hose 41. The pressure generator 38 is in communication with the interior of the pressure vessel via a threaded hollow stub 43 screwed into the top surface of the pressure vessel. On the back side of the pressure generator is a series of outwardly projecting exit orifices 96 for exhausting the airflow arriving from the air source used to create the vacuum.

During use, the pressure generator 38 may be selectively actuated to create a vacuum (negative pressure) both within the pressure vessel 36 and an associated fluid pathway in communication with the vessel to draw fluid into the pressure vessel.

The pressure generator 38 is capable of pulling approximately a level of 22 inches Mercury (Hg) within about 20–30 seconds. At 22"Hg the negative pressure is about 26% of atmospheric pressure at sea level. At 14.2"Hg the negative pressure is about 53% of atmospheric pressure. An exemplary proprietary pressure generator satisfying these parameters is available from Norco Industries in Elkhart, Ind. It will be appreciated, however, that these parameters are not meant to be limiting and that other suitable negative pressure parameters may be suitable for performing the fluid servicing procedures described herein.

Figure 6:
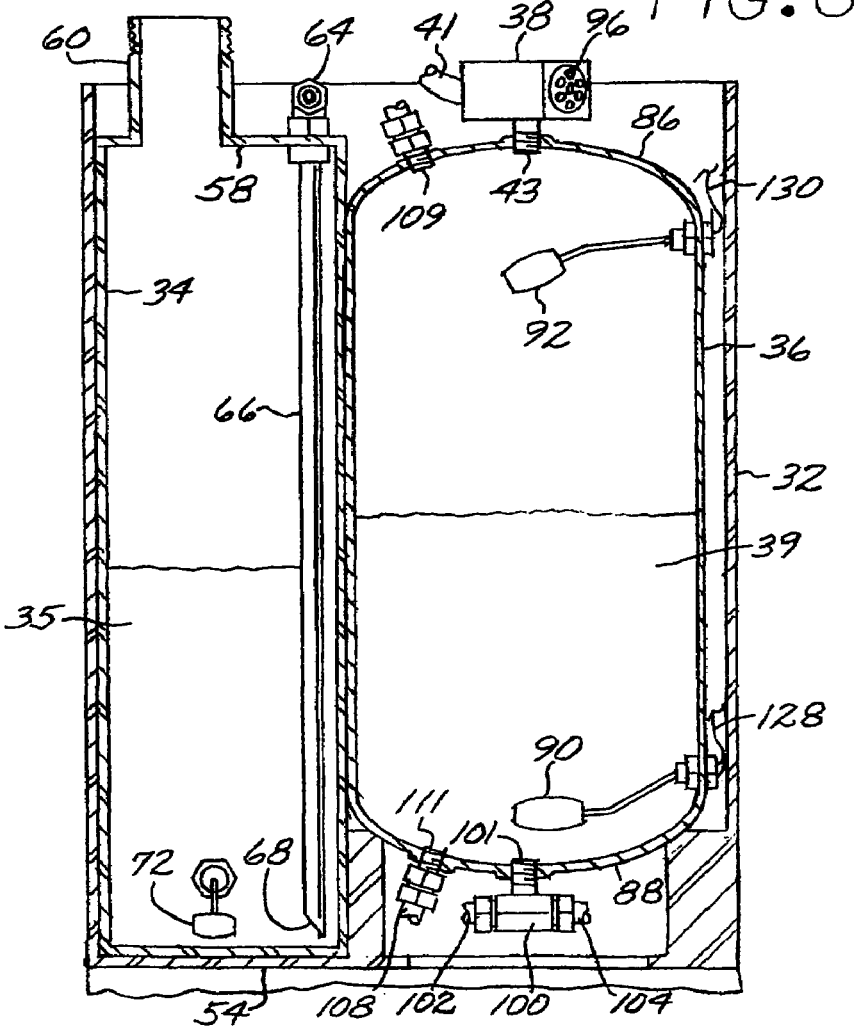
FIG. 6 is a right side sectional view, in enlarged scale, taken along lines 6—6 of FIG. 5.
Figure 20:
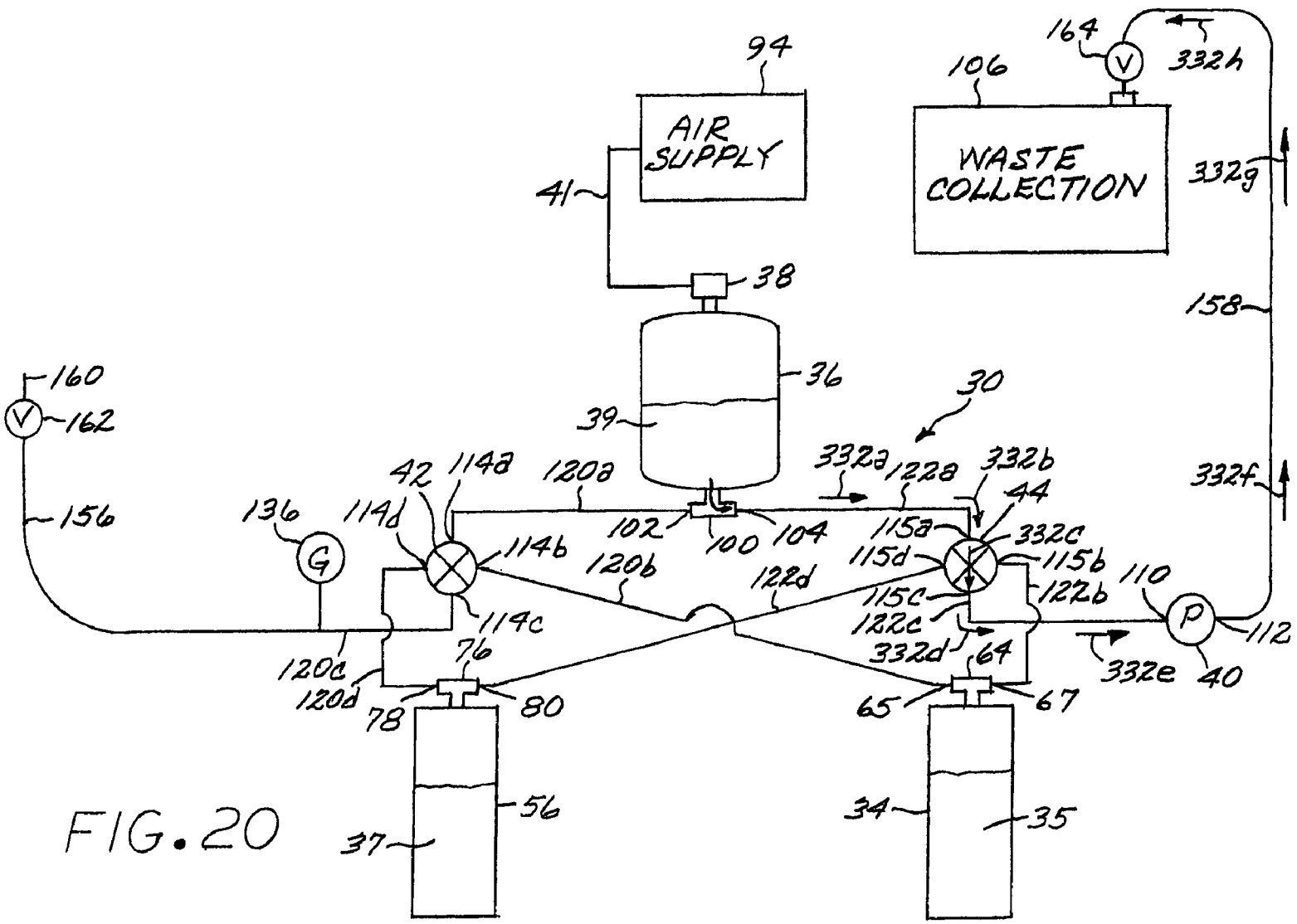
FIG. 20 is a schematic of an exemplary plumbing circuit for draining the waste and fluid supply tanks of the radiator fluid exchanging apparatus of FIG. 1.

With particular reference to FIG. 6, at the bottom of the waste tank 36 is a T-shaped multi-directional flow waste fluid coupling 100. Such coupling is in communication with the interior of the waste tank via a hollow threaded stub 101 and includes a waste collection inlet 102 and a waste fluid exhaust 104. Advantageously, this enables fluid to be received into the waste tank 36 from another source such as the remove and fill control manifold 42 or to direct fluid out of the waste tank through the flush control manifold 44, such as during the drain waste tank process, to an external drain collection tank 106 (FIG. 20). The waste tank is preferably larger in diameter than either of the two fluid supply tanks 34 and 56 and generally constructed to hold about 4–5 gallons of waste fluid 39 before requiring the tank to be drained.

With continued reference to FIG. 6 and also FIG. 14, a fluid level sight tube 108 for providing a visual indication of the fluid level within the waste tank 36 has an upper end connected to a threaded hollow stub 109 screwed into the pressure vessel's top surface 86 and with a lower end connected to a threaded hollow stub 111 screwed into the pressure vessel's bottom surface 88. The sight tube 108 is preferably made of clear plastic, glass, or other suitable material and extends forwardly through an opening in the front wall of the cabinet 32 so as to be visible to an operator standing in front the servicing apparatus 30.

Referring to FIGS. 14 and 17, the plumbing system further includes the pump 40 which includes a fluid receiving inlet 110 and a fluid directing outlet 112. In this exemplary embodiment, the pump is a diaphragm pump that operates on a 12VDc power source such as a vehicle battery and is rated to provide an outlet pressure flow up to approximately 20 psi. An exemplary pump is available from Shur-flo Pump Manufacturing Company at www.shurflo-.com. It will be appreciated that this pressure rating is sufficient to force fluid through the thermostats in the radiator cooling loop although other suitable pump ratings and fluid pump configurations such as vane pumps may also be used.

With reference to FIG. 17, interposed between the waste collection tank 36 and the primary and auxiliary supply tanks 34, 56, respectively, is a pair of control manifolds for directing supply and waste fluids, 35, 37, and 39, respectively, between the tanks and also to the pump 40. In this exemplary embodiment, there are two control manifolds including the remove and fill control manifold 42 and the flush control manifold 44. Suitable ball valves are available from Parker Hannifin. Both manifolds 42 and 44 are constructed in a similar manner and an exemplary remove and fill control manifold 42 without any hose couplings or dial is illustrated in FIG. 9. The exemplary remove and fill manifold 42 is in the form of a ball valve including four ports 114*a*, 114*b*, 114*c*, and 114*d* for receiving or exhausting fluid. Each port may be coupled to a conduit such as those designated 120*a*, 120*b*, 120*c*, and 120*d* in FIG. 9. Fluid passing through the manifold may be transported to other plumbing components via these conduits. In practice, these conduits are normally constructed of flexible plastic tubing, however, any suitable fluid transportation structure between the plumbing components, such as hoses, pipes, or lines, whether rigid or flexible, may be used.

The manifold 42 also includes a dial key 116 for receiving a control dial that may be manually operated to selectively open passageways between the ports as will be described in further detail below. To secure the manifold to the inside of the cabinet 32 behind a control panel 202, a mounting section 118 constructed to receive a threaded fastener or bolt is also provided for mounting to a complementary mounting section on the control panel. The flush control manifold 44 is constructed in an identical manner with ports 115*a–d* (FIG. 14) connected to conduits 122*a–d*, respectively (FIGS. 14 and 20).

Figure 16:
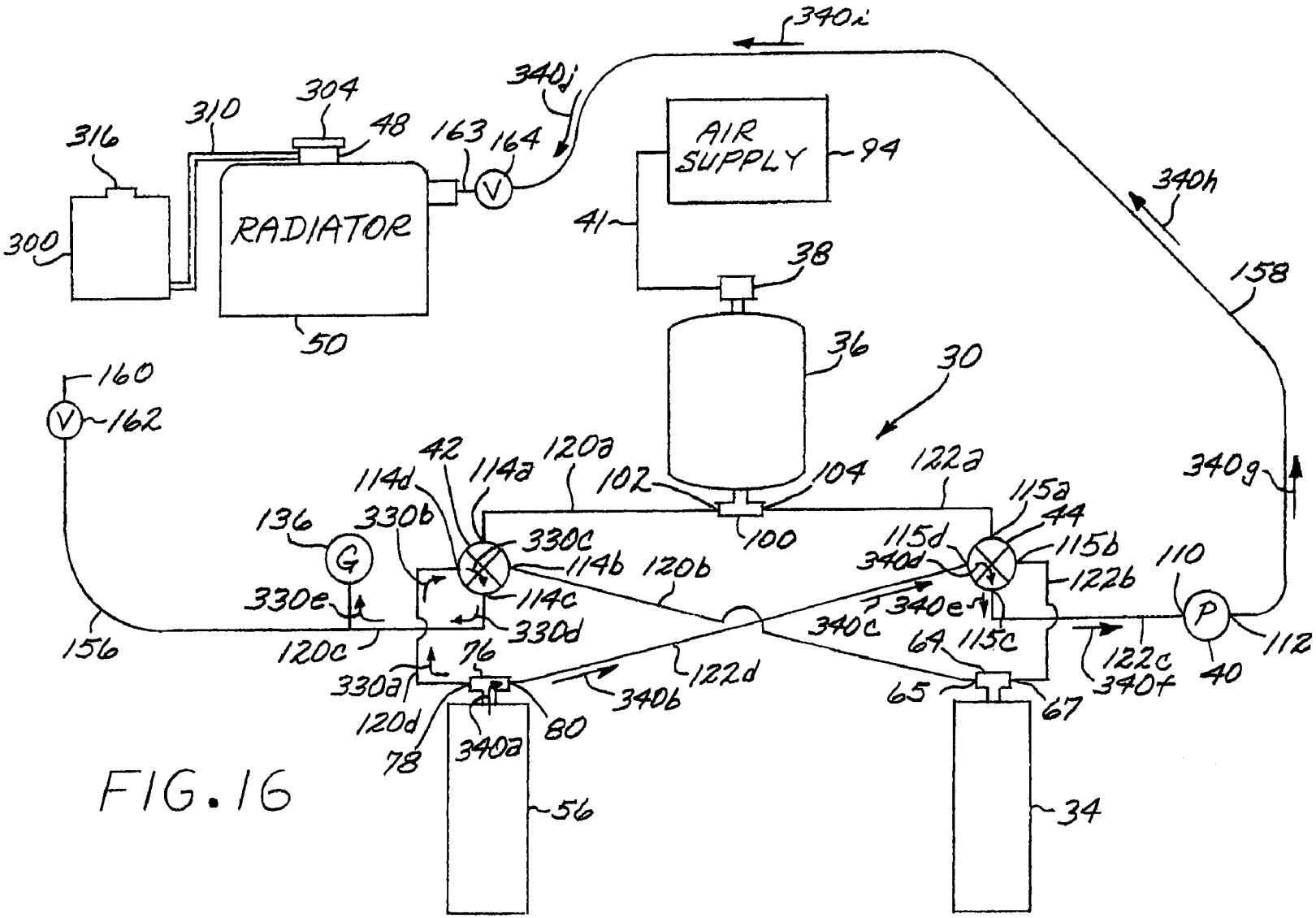
FIG. 16 is a schematic of an exemplary plumbing circuit for performing a pressure test on an engine cooling system, such as that illustrated in FIG. 12, using the radiator fluid exchanging apparatus of FIG. 1.

Turning now to FIGS. 16–17, two exemplary plumbing circuits are illustrated for performing various fluid servicing procedures to the vehicle coolant system. The remove and fill control manifold 42 includes a waste exhaust port 114*a*, a primary fluid supply tank inlet 114*b*, a pressure gauge port 114*c*, and an auxiliary fluid supply tank inlet 114*d*. The waste exhaust port 114*a* is coupled via conduit 120*a* to the waste collection inlet 102 of waste fluid coupling 100 of the pressure vessel 36. The primary fluid supply tank inlet 114*b* is connected to the supply outlet 65 of the primary fluid supply tank 34 via conduit 120*b*. The pressure gauge port 114*c* is coupled to a pressure gauge 136 via conduit 120*c*. The auxiliary fluid supply tank inlet 114*d* is coupled to the auxiliary tank supply outlet 78 via conduit 120*d*. The remove and fill control manifold is primarily operated in conjunction with the pressure generator 38 to remove and replace fluids under vacuum pressure.

In a similar manner the flush control manifold 44 is interposed between the pressure vessel 36 and primary fluid supply tank 34 and auxiliary fluid supply tank 56 and the pump 40. The flush control manifold includes a drain inlet port 115*a*, a primary fluid tank supply inlet 115*b*, a pump supply outlet 115*c*, and an auxiliary fluid supply tank inlet 115*d*. A conduit 122*a* connects the drain inlet port 115*a* to the waste collection exhaust 104 of the coupling 100 of the waste tank 36. Another conduit 122*b* connects the primary fluid supply tank inlet 115*b* with the second supply outlet 67 of the primary fluid supply tank 34. A third conduit 122*c* couples the pump supply outlet 115*c* with the pump inlet 110. A fourth conduit 122*d* connects the auxiliary fluid supply tank inlet 115*d* with the auxiliary tank outlet 80. Via a control panel 224 (FIG. 7) as will be explained in further detail below, the control manifolds 42 and 44 may be manually electively positioned to direct fluid throughout the plumbing system. The flush control manifold is primarily used in conjunction with the pump 40 to supply fluid to the engine cooling system 52 (FIG. 12) under pump pressure, drain the waste tank 36, or flush the primary fluid supply tank 34 and the auxiliary fluid supply tank 56.

Referring to FIGS. 1, 14 and 17, two other conduits or elongated servicing hoses are conveniently incorporated into the servicing apparatus 30 including a remove and fill conduit 156 that is colored black in practice to distinguish from a red supply conduit 158. The remove and fill conduit 156 is coupled at one end to conduit 120 and is in communication with the pressure gauge 136. The remove and fill conduit also includes a free end 160 with a ball valve 162 to open and close an internal fluid flow passage. The supply conduit 158 is coupled at one end to the pump outlet 112 and also includes a free end 163 with a ball valve 164 for similar purposes.

Figure 13:
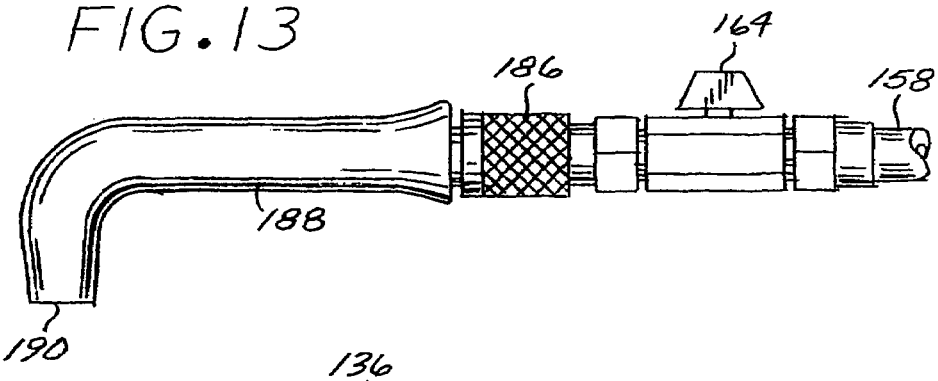
FIG. 13 is a partial side view of one end of an alternative servicing hose adapter.

In practice, the free ends 160, 163 of each of the respective hoses 156, 158 include quick disconnects for attaching a variety of adapters as would be understood and selected by a service technician. Referring to FIGS. 10, 11, 13, three such exemplary adapters are illustrated. In FIG. 10, the remove and fill servicing hose 156 includes the ball valve 162 and a quick disconnect 166 that may be attached to a cone adapter 168 with a tapered rubber seal 169 having a central bore 171. The cone adapter is normally inserted into the fill neck 48 of the radiator 50 (FIG. 17) during the remove and fill procedure. Such adapter ensures a tight seal is formed in the fill neck while allowing fluid to pass through the bore 171.

Another exemplary adapter is illustrated in FIG. 11. This multi-function adapter, generally designated 170, includes a valve housing 172 which includes a pair of ports 192, 194 for coupling to the ends of the servicing hoses 156 and 158, respectively. An opposing pair of ports 196, 198, respectively, may be coupled to a straight adapter 174 and a bent adapter 176 on the other side of the housing 172. A two position flowthrough/bypass valve 178 includes a push/pull knob 180 that an operator may grasp to alter the flow entering and exiting the adapter 170. In the normal position for push/pull knob 180 as illustrated in FIG. 11, the fluid flows straight through from conduit 158 to adapter 176 and from conduit 156 to adapter 174, as illustrated by directional arrow 182. In the alternative position for push/pull knob 180 (not shown), the fluid flow passing through conduit 158 into the adapter 170 is returned through the housing to conduit 156, as illustrated by directional arrow 185. Likewise, fluid entering conduit 156 may be recirculated to conduit 158.

With continued reference to FIG. 11, a crossflow valve 182 with a push/pull knob 184 is provided to reverse the flow to remove the necessity of performing a quick disconnect if the servicing hoses are coupled to the engine cooling system 52 incorrectly. In the normal position with the push/pull knob 184 flush against the housing 172 as shown in FIG. 11, fluid passes through straight across from the conduit 158 to the bent adapter 176 and from the conduit 156 to the adapter 174 as illustrated by directional arrow 182. When the knob 184 is pulled away from the housing 172, the valve 182 switches the flow such that fluid entering the housing from conduit 158 is transferred to adapter 174 and fluid entering the housing 172 from conduit 156 is directed to adapter 176 as illustrated by directional arrow 187. While an experienced service technician will know which hoses to connect to the engine cooling system in accordance with the water pump flow direction, a lesser skilled person may not and thus may merely pull the knob 184 to reverse the flow. This saves the time associated with disconnecting the hoses and reconnecting in the correct manner.

Another exemplary adapter 188 is illustrated in FIG. 13 as attached to a quick disconnect 186 of the supply servicing hose 158 downstream of the ball valve 164 when fluid is exiting the adapter. Such adapter includes an open end 190 and is typically used to supply fluid to the engine coolant system or to a waste collection tank 106. If attached to the remove and fill conduit 156, such adapter may be used to suction fluid out of the engine cooling system 52 (FIG. 12) as well.

Electrical Subsystem

Figure 15:
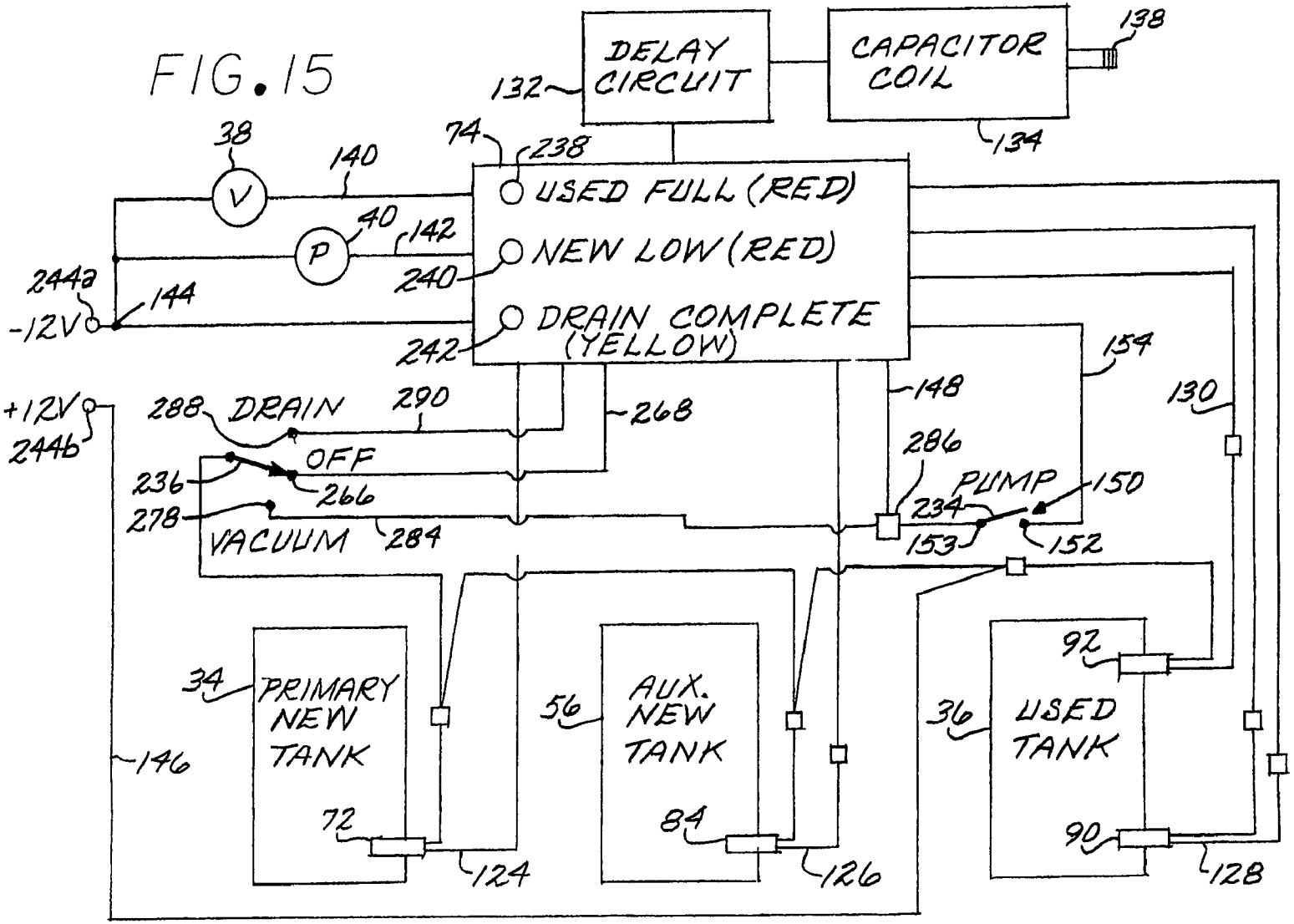
FIG. 15 is a schematic of an exemplary electrical control circuit of the radiator fluid exchanging apparatus of FIG. 1.

Referring now to FIGS. 6 and 15, to provide feedback of fluid levels within each tank, a low level sensor is hardwired to a main circuit board or controller 74. For example, a low level sensor 72 is secured near the bottom of the inside of the primary fluid supply tank 34. This low level sensor 72 is hardwired to the main board 74 via wire lead 124 to transmit a signal to the main board indicating the fluid level in the primary fluid supply tank 34 is below a predetermined level.

A similar low level sensor 84 is employed in the auxiliary fluid supply tank 56 as well and is hardwired to the main board via wire lead 126.

With continued reference to FIGS. 6 and 15, within the waste tank 36 is a low level fluid sensor 90 and a high level fluid sensor 92 mounted to the inside wall at respective lower and upper positions. The low level fluid sensor 90 is hardwired to the main board 74 via wire lead 128. The high level fluid sensor 92 is also hardwired to the main board via wire lead 130. Both fluid level sensors 90 and 92 transmit fluid level signals to the main board for processing. In use, the main board processes the signals received from the fluid level sensors 72, 84, 90, and 92 and illuminates an LED accordingly or issues a control signal to one of the electrical plumbing components as will be described in more detail below. These sensors 72, 84, 90, and 92 are in the form of float valves. A suitable sensor may be purchased from www.gemssensors.com.

As the waste tank 36 is frequently under negative pressure during use, the waste fluid 39 within may expand or contract and create a false fluid level reading thus prematurely tripping one of the fluid level sensors and shutting off the machine 30. To prevent this occurrence, it is preferable to build in a delay into the high level sensor circuit path in the form of a delay circuit 132 with an adjustable capacitor coil 134 in electrical communication with the main board 74. The delay circuit measures the time period over which a high fluid level signal is received from the high level fluid sensor 92. If the time period measures over a predetermined time period, then the delay circuit transmits a signal to the main board that the fluid level measurement is accurate and not merely due to a temporary expansion of the fluid. Upon receiving this confirmation signal from the delay circuit, the main board 74 is programmed to shut down the pressure generator 38 so that no further waste fluid 39 is drawn into the waste vessel 36.

It has been found that an approximately 7 second built-in delay provides satisfactory results in most fluid servicing scenarios. However, it will be appreciated that this delay may be adjusted to accommodate the atmospheric conditions including both sea level and high altitude conditions as well as in between these two extremes. For example, a small set screw 138 (FIG. 15) may be coupled to the capacitor coil 134 to adjust the time delay using a conventional methods. By rotating the screw, the time predetermined time period may be increased or decreased as desired by the service technician. For example, a delay of 11 seconds for performing servicing procedures at altitude in Denver, Colo. may be sufficient. It will be appreciated that the delay circuit and capacitor element could be inserted in the circuit between the high level sensor 92 and the main board 74 as well. A suitable main board 74 with delay circuit 132 is available from Norco Industries in Elkhart, Ind.

With continued reference to FIG. 15, also hardwired to the main control board 74 is the pressure generator 38 via wire lead 140 and the pump 40 via wire lead 142. The pump, pressure generator, and main control board are in turn connected to the negative battery cable 244*a* via a wiring harness, schematically illustrated at 144 in FIG. 15. The sensors 72, 84, 90, and 92 are in electrical communication with the positive battery cable 244*b* via wire lead 146.

Further hardwired to the main board 74 is a two-position pump power actuator switch 234 and a three position pressure generator actuator switch 236. The pump switch 234 is illustrated in the open position in FIG. 15 as indicated by reference numeral 150. The switch is closed when it rests against the contact 152 which is hardwired to the main board via wire lead 154. The pressure generator switch 236 includes a first position contact 266 for sending a power off command to the main board via wire lead 276. A second position contact 278 transmits a Vacuum On signal to the main board via wire lead 284 to actuate the pressure generator to create negative pressure in the pressure vessel 36. The second position contact 278 is also directly wired to the second contact 153 of the pump switch 234 at junction 286. Junction 286 is hardwired to the main board via wire lead 148. When the pressure generator switch 236 is placed against a third contact position 288, a Drain signal is transmitted to the main board via wire lead 290. When the Drain signal is received, the main board 74 is programmed to issue a command signal to the pump 40 to suction waste fluid 39 in the pressure vessel 36 out of the vessel.

Cabinet and Control Panel

Turning now to FIGS. 1–6, the characteristics of the cabinet 32 of the radiator fluid servicing apparatus 30 are depicted. With specific reference to FIGS. 1, 5, and 6, the majority of the fluid transportation components are conveniently provided in the wheeled cabinet 32 having a bottom shelf 54 for supporting the three tanks, 34, 36, and 56. These three tanks are tangentially situated in a roughly triangular pattern when viewed from above (FIG. 5) with the primary fluid supply tank 34 on the right side of the cabinet, as viewed from FIG. 2, the auxiliary fluid supply 56 on the left forward side of the cabinet, and the pressure vessel 36 situated in a rearward position.

With reference to FIGS. 1–4, the cabinet 32 generally includes a lower fluid receptacle enclosure 200 and an upper control section 202 mounted on top of the lower section. A pair of rear wheels 204*a*, 204*b* is supported from an axle 206 passing through the lower extremity of the back side of the receptacle enclosure. Left and right caster wheels 208*a*, 208*b* are coupled to the left and right front lower corners of the cabinet to facilitate easy turning. These wheels may include a brake to prevent the cart from rolling during servicing procedures or while in storage. A convenient rear step 210 (FIG. 3) is recessed in the back of the lower portion to facilitate tilting the front end of the cabinet rearwardly to lift the front wheels 208*a*, 208*b* over an obstacle.

Figure 2:
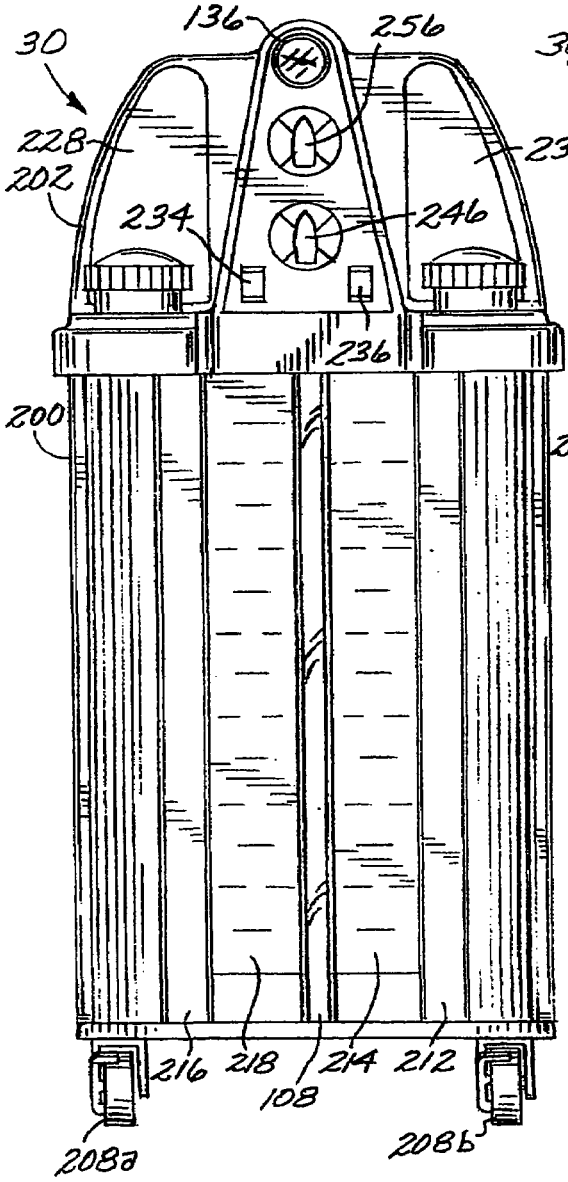
FIG. 2 is a front view, in enlarged scale, of the radiator fluid exchanging apparatus of FIG. 1.
Figure 3:
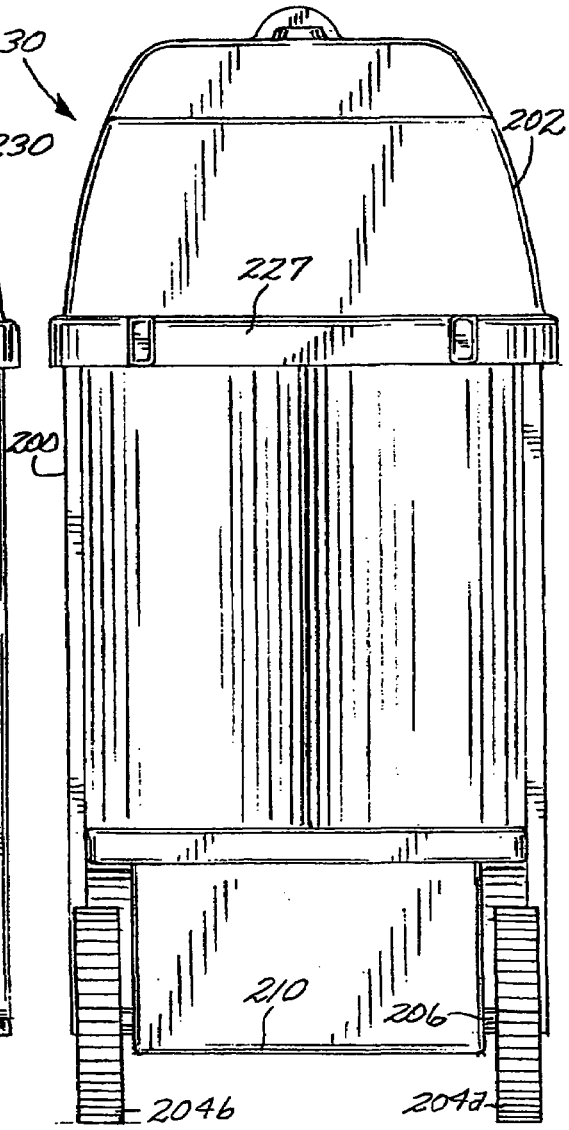
FIG. 3 is a rear view, in enlarged scale, of the radiator fluid exchanging apparatus of FIG. 1.
Figure 4:
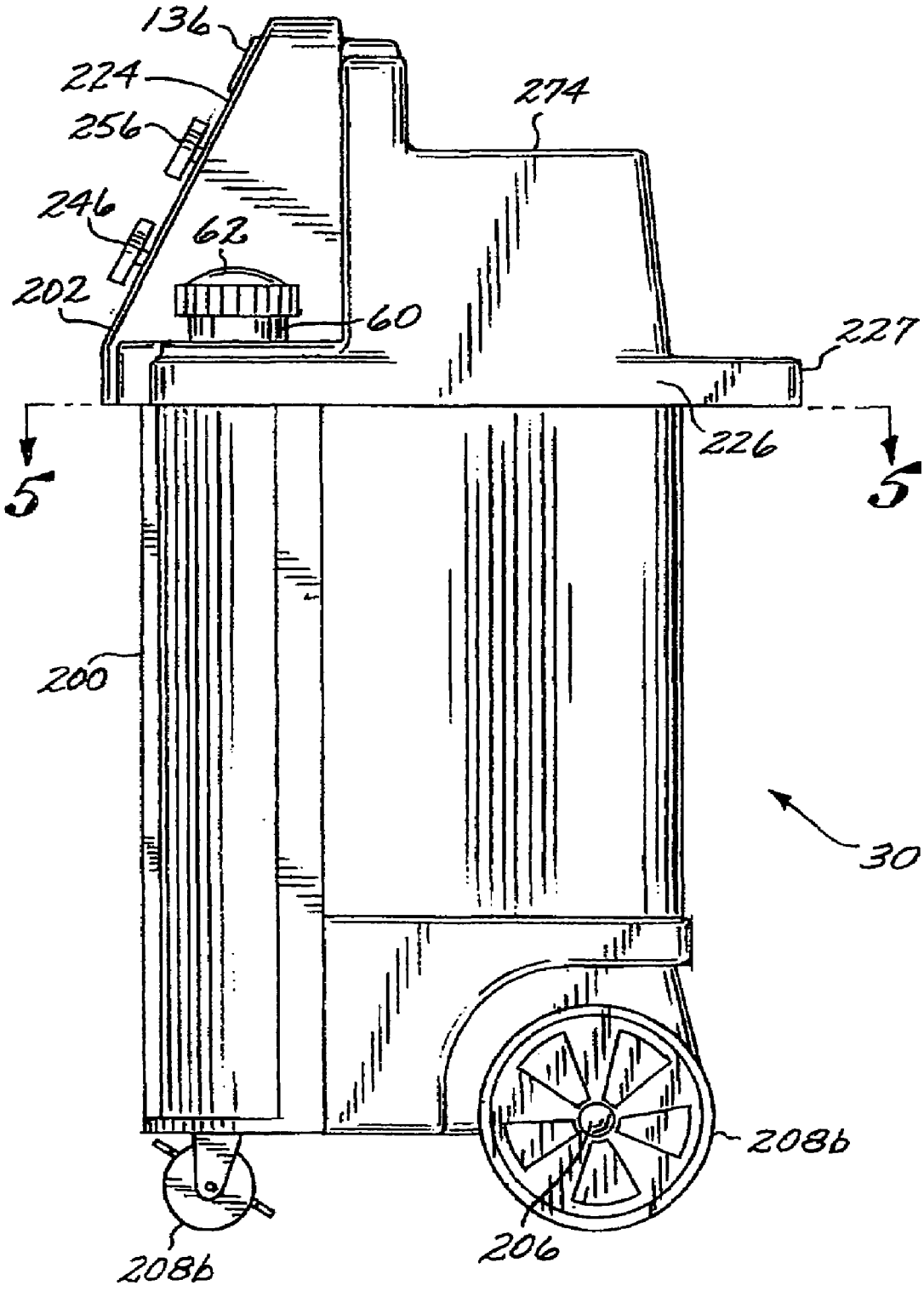
FIG. 4 is a right hand end view, in enlarged scale, of the radiator fluid exchanging apparatus of FIG. 1.
Figure 5:
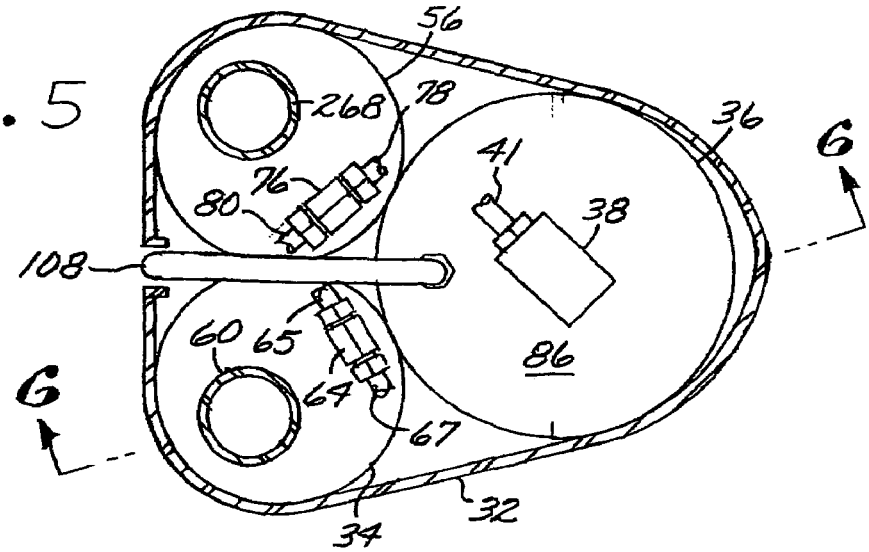
FIG. 5 is top sectional view, in enlarged scale, taken along lines 5—5 of FIG. 4.

On the right side of the front of the enclosure 200 as viewed in FIGS. 1 and 2, a tank sight level gauge 212 projects from the bottom of the enclosure to the bottom edge of the control section. Along side the sight level gauge, is a series of hash marks 214 corresponding to the level of primary fluid 35 in the primary fluid supply tank 34. A similarly constructed sight level gauge 216 is located on the front left side of the enclosure to provide a visual indication of the fluid level in the auxiliary fluid supply tank 56 inside the enclosure via hash marks 218. The central clear tube 108 of the waste tank 36 is positioned in a vertically projecting slot between the hash mark sections 214, 218 to provide a visual indication of the level of waste fluid 39 in the waste tank 36.

Turning to FIGS. 1, 2, 4, and 7, the control section 202 sits atop the enclosure 200 and houses most of the plumbing components other than the three tanks 34, 36, and 56 as well as the main board 74 (FIG. 15) that provides an interface between a control panel 224 and the pump 40 and vacuum generator 38. The bottom edge of the control section includes an enlarged base 226 extending beyond the outer circumference of the enclosure below as viewed in FIGS. 1–4. A handle 227 extends rearwardly from the enlarged base 226 to facilitate movement of the servicing apparatus 30 by the service technician.

When viewed from the front as in FIGS. 1–2, the control section 202 includes a vertically projecting, central control panel 224 positioned between two rearwardly recessed vertically projecting panels 228, 230 upon which convenient operating instructions (not shown) may be posted. A partial sectional view of an exemplary control panel 224 is illustrated in FIG. 7. The control panel is vertically oriented with a status area 232 near the bottom edge of the control panel bounded by the pump power actuator switch 234 on the left and the vacuum generator actuator switch 236 on the right.

Referring to FIGS. 7 and 15, the status area 232 includes three LEDs to indicate the status of processes being provided by the servicing apparatus 30. The uppermost LED 238 indicates when the waste fluid tank 38 is full. This LED lights up when a signal is received from the high level fluid sensor 92 in the waste tank 36 when the fluid level triggers this switch. The middle LED 240 indicates when the respective fluid level in either the primary fluid supply tank 34 or auxiliary fluid supply tank 56 is low. In operation, this LED 240 illuminates when a signal is received by the main board 74 from the low level switch 72 in either the primary fluid supply tank 34 or the low level switch 84 in the auxiliary fluid supply tank 56.

The bottom LED 242 may provide an indication that the used fluid tank drain procedure is complete. This LED is energized by the main board once the low level switch 90 in the waste tank 36 detects a low fluid level condition and transmits a corresponding signal to the main board 74 for further processing after the drain waste tank procedure is initiated.

For example, when the fluid level in the waste tank 36 falls below a predetermined level during the drain waste tank procedure as indicated by the position of the low level indicator 90, the low level float valve 90 sends a signal to the control board 74 which transmits a signal to illuminate the Used Fluid Tank Drain Complete LED 242. On the other hand, if the fluid level in the waste tank 36 surpasses a predetermined high level as determined by the position of the upper float valve 92 and further processing by the delay circuit 132, a signal is generated by the upper float valve and transmitted to the control board 74 which illuminates the Used Fluid Tank Full LED 239 on the control panel 224.

The dual position left vacuum/drain switch 234 controls the activation/deactivation of the supply pump 40. Depressing the upper end of the switch 234 closes the switch against contact 150 and transmits a signal via wire lead 154 to the main board 74 to issue a command signal turn the pump on. This assumes a pair of battery cables 244*a*, 244*b* is in electrical communication with the control board 74 and pump 40 and connected to a source of power such as the vehicle battery. Depressing the lower end of the switch 234 open the contact and transmits a signal to the main board to deactivate the pump.

The vacuum switch 236 on the right side of the control panel 224 is a three position switch. Depressing the upper end of the vacuum switch moves the switch 236 against the drain contact 288 and transmits a signal to the main board via wire lead 290 to activate the pump 40 to suction waste fluid 39 from the waste tank 36 out of the tank through the coupling 100. If the vacuum switch is placed in the middle position against contact 266, the switch 236 strikes contact 266 and transmits a signal along wire lead 268 to the main board to deactivate the vacuum generator. Depressing the vacuum switch to the lower position against the vacuum contact 278 transmits a signal via wire lead 284 through junction 286 and wire lead 148 to the main board to activate the pressure generator 38 to build up negative pressure in the waste tank 36 to draw fluid therein.

With continued reference to FIG. 7, above the status area 232 on the control panel 224 are two vertically aligned, four position, control dials. The flush/drain dial 246 in the lower position includes an OFF position, indicated at 248, a FLUSH FIRST FILL TANK (GREEN) position, indicated at 250, for flushing the primary fluid supply tank 34, a FLUSH SECOND FILL TANK (RED) position, indicated by reference numeral 252, for flushing the auxiliary fluid supply tank 56, and a DRAIN WASTE TANK POSITION, indicated at 254, for draining the waste tank 36. The lower dial 246 may be manually selectively rotated by the service technician to any of these four positions. The supply/remove dial 256 in the upper position includes a REMOVE FLUID position, as indicated by reference numeral 258, a SUPPLY FLUID FROM FIRST FILL TANK position, as indicated at 260, a SUPPLY FLUID FROM SECOND FILL TANK position, at 262, and a PRESSURE TEST initiation position, indicated by reference numeral 264. The upper dial 256 may also be manually selectively rotated by the operator to any of these four positions. The upper and lower dials 256, 246 are connected to the respective dial key 116 of the remove and fill control manifold 42 and flush control manifold 44, respectively. Using a combination of these dials 246, 256 and switches 234, 236 to activate the various plumbing components and direct fluid through the fluid paths described herein, the operator can perform a number of procedures for servicing a vehicle radiator 50 (FIG. 12) or drain the primary, auxiliary, and waste tanks 34, 56, and 36, respectively, of the servicing apparatus 30. Positioned above the upper dial 256 on the control panel 224 is an analog pressure gauge 136 (FIG. 1) in line with the service hose 156 and conduit 120*c* for providing a readout of the pressure generated in those lines or issuing from the remove and fill control manifold 42 during the pressure test.

To either side of the control panel 224, the base 226 includes an aperture through which the fill neck 60, 268, respectively, of each of the respective primary and auxiliary fluid supply tanks 34, 56 projects. Each fill neck 60, 268 preferably includes a threaded cap 62, 270, respectively, to prevent spillage during movement of the cart. An open topped storage recess 274 is also conveniently provided on the back side of the control section for storing adapters or other servicing equipment.

With reference to FIGS. 1 and 17, servicing hose 156 couples to the remove and fill control manifold 42 while servicing hose 158 couples to the outlet 112 of the pump 40 inside the enclosure 200 and control section 202. Each hose exits the base 226 on the underneath of the right side of the cabinet 32. Conveniently, a hose hanger 280 projects upwardly from the top of the control section 202 and includes a pair of hooks 282*a*, 282*b* for hanging the servicing hoses or other hoses, such as the air source hose 41, for organizational purposes and storage.

Conventional Engine Cooling System

Turning now to FIG. 12, an exemplary conventional engine cooling system 52 illustrated. Such cooling system generally includes a radiator unit 50, a water pump 292, a fan 294, an engine block 296, a heater core 298, and an overflow bottle 300 cooperating with a set of conduits to form a cooling loop. The radiator includes a fill neck 48 with a radiator cap 304 and an influent or upper hose 306 and an effluent or lower hose 308. Either the fill neck 48 or the radiator port where the influent hose is disconnected may provide an influent port 307 depending on the servicing procedure and hose the servicing apparatus 30 is coupled to the engine cooling system 52. Likewise, the fill neck 48 or the radiator port where the effluent hose 308 is disconnected may provide an effluent port 46 depending on the servicing procedure being performed and how the servicing apparatus is coupled to the engine cooling system 52.

An overflow hose 310 is coupled to the radiator cap 304 and allows fluid under pressure to be routed to the overflow bottle 300 to release pressure on the radiator. The overflow bottle includes a cap 316 removably coupled to the fill neck 320 of the overflow bottle 300.

In this exemplary embodiment and the processes described herein, it will be assumed the normal direction of coolant flow is from radiator effluent line 308 through the water pump 292 and into the heater core 298 via line 312. The coolant exits the heater core via line 314 and into the engine block 296 where it exits into the influent line 306 and returns to the radiator 50. In addition, at least one thermostat (not shown) is in the engine cooling system. Such thermostat opens once the engine reaches a predetermined temperature allowing coolant to flow through the system. It will be appreciated that the coolant may flow in a reverse direction as determined by the water pump 292, and that the influent and effluent hoses 306, 308, respectively, and their respective ports may be reversed.

With the foregoing exemplary construction in mind, operation of the radiator fluid exchanging apparatus 30 will now be described.

Operation of the Radiator Fluid Servicing Apparatus

In operation, the user will appreciate the versatility of the radiator fluid exchanging apparatus 30 to facilitate several fluid exchange procedures including radiator fluid removal, radiator fluid fill, topping off the radiator, flush exchange, and a pressure test procedure as well as draining the waste tank 36 and flushing the primary and auxiliary fluid supply tanks 34 and 56, respectively. The following procedures are performed with the engine turned off and unless specified otherwise it is assumed the operator has connected the battery clamps 244*a*, 244*b* to the vehicle battery using conventional techniques to supply power to the electrical components of the radiator fluid exchanging apparatus 30. Shop air 94 is also assumed to be supplied to the pressure generator 38 via air hose 41 during these procedures.

Remove and Fill Procedure

Prior to initiating a remove and fill procedure, the vehicle is preferably at operating temperature, with the engine recently turned off. This assists in keeping the thermostats open although the present invention preferably includes a pump 40 capable of generating sufficient pressure to force the thermostats open if necessary.

Referring to FIGS. 1, 12, and 13, as an initial procedure, the service technician may elect to remove radiator fluid from the overflow bottle 300. In performing this procedure, the operator may connect the suction wand 188 to the quick disconnect assembly 166 of the black service drain line 156. The overflow bottle cap 316 is removed. The ball valve 156 on the drain line may be rotated open and the open end 190 of the adapter 188 may be placed within the overflow bottle 300. Although shown as being placed into the radiator 50 in FIG. 17, it will be appreciated that a service technician would understand how to place the adapter into the overflow bottle 300.

Referring to FIGS. 7, 14, and 17, the operator sets the upper dial 256 to the REMOVE FLUID position 258 to interconnect the inlet port 114*c* with outlet port 114*a*. The operator may then depress the vacuum switch 236 on the control panel 224 to the Vacuum On position 278 to actuate the vacuum generator 38 to suck fluid out of the overflow bottle 300 and into the waste vessel 36 through the service line 156. Fluid is drawn through service line 156 and into conduit 120*c*. From there fluid enters inlet port 114*c* and exits out of outlet port 114*a* and into conduit 120*a* to pass through the inlet 102 of coupling 100. After entering the coupling 100, the fluid is drawn through the hollow stub 101 (FIG. 6) and into the pressure vessel 36 where it is collected. The fluid being vacuumed in this manner follows the fluid path designated by directional arrows 326*a–j* (FIG. 17).

Figure 19:
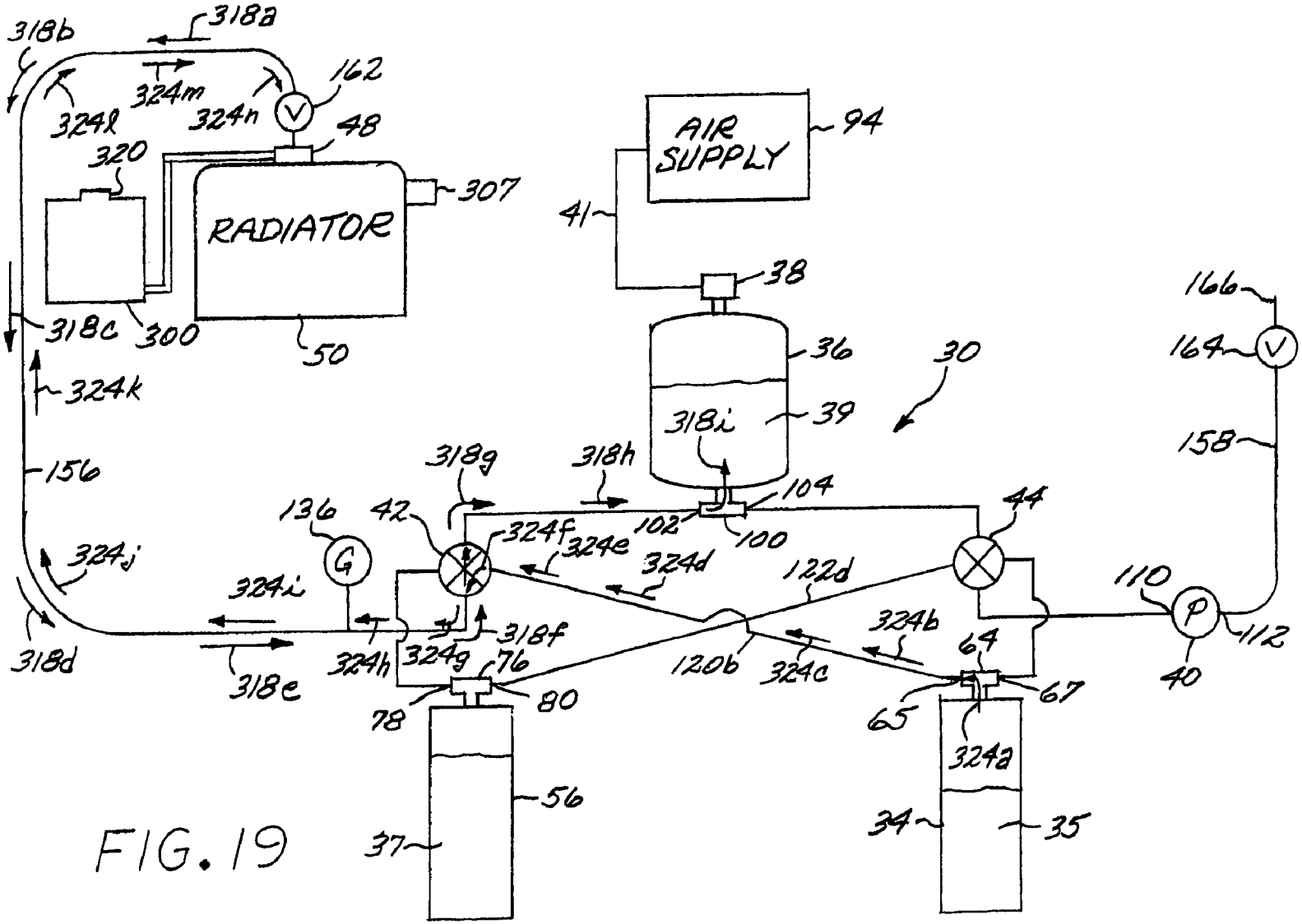
FIG. 19 is a schematic of an exemplary plumbing circuit for performing a fluid exchange with an engine coolant system using negative pressure.

With reference to FIGS. 7, 14, and 19, to remove fluid from the radiator 50 directly, the operator may remove the radiator cap 304 using conventional precautions to avoid injury associated with such removal. The suction wand 188 is replaced with the cone adapter 168 (FIG. 10) which may then be placed into the open radiator fill neck 48. On the control panel 244, the operator rotates the upper dial 256 (FIG. 7) to the REMOVE FLUID position 258. This places inlet port 114*c* in communication with outlet port 114*a*. The service technician also rotates the bottom dial 246 to the DRAIN WASTE position 254. This places the inlet port 115*a* in communication with outlet port 115*c*. This is a default position during this procedure although the pump is not used during the procedure and the lower dial may be set to any of the four positions.

The ball valve 162 on the drain service line 156 is then rotated to the open position. Back at the control panel 224, the vacuum switch 236 may be depressed by the operator to the ON position 278 (FIG. 15) to activate the vacuum generator 38 atop the waste tank 36. As the vacuum builds, the fluid from the radiator 50 is drawn through the cone adapter bore 171, through the service line 156, and into conduit 120*c*. The radiator fluid exits the conduit 120*c* and enters inlet port 114*c* and passes through the remove and fill control manifold 42. After exiting the outlet port 114*a* and passing through conduit 120*a*, the radiator fluid enters the waste tank 36 via the inlet 102 and hollow stub 101 of the coupling 100. This fluid path is indicated by directional arrows 318*a–i* (FIG. 19).

The operator may allow this to continue until the desired amount of radiator fluid is withdrawn from the radiator by observing the fluid level on the sight tube 108. Once the desired amount of radiator fluid is collected in the waste tank 36, on the control panel 224, the vacuum switch 236 may be toggled to the middle OFF position 266 (FIG. 15) by the service technician.

It will be appreciated that a vacuum persists in the radiator 50 due to the seal formed by the cone adapter 168 within the fill neck 48 of the radiator and radiator fluid removed therefrom. To introduce supply fluid back into the radiator 50, the operator may switch the top dial 256 to either the primary fluid supply tank or auxiliary fluid supply tank setting 260, 262, respectively, depending on which fluid is to be supplied to the radiator as will now be explained in further detail.

With continued reference to FIG. 19, assuming the primary fluid supply tank 34 is selected to supply fluid to the radiator 50, the top dial 256 is rotated to the primary fluid supply tank setting 260. This opens a fluid pathway in the remove and fill control manifold 42 between inlet port 114*b*, which is connected to the outlet 65 of the multi-directional coupling 64 of the primary fluid supply tank 34 via conduit 120*b*, and outlet port 114*c*. In this configuration, the radiator fill neck 48 also provides an influent port in communication with the primary fluid supply tank. Once the top dial 256 is rotated to this position by the service technician, primary fluid 35 is drawn out under vacuum through outlet 65 through conduit 120*b* and into the remove and fill control manifold 42. The primary fluid enters inlet port 114*b* and then enters conduit 120*c* through outlet port 114*c*. The fluid is then drawn through conduit 120*c* and servicing hose 156 and into the radiator 50 through the cone adapter 168. This primary fluid supply path under vacuum is indicated by directional arrows 324*a–n*.

Reading the pressure gauge 136, the operator may then wait until pressure in the radiator returns to atmospheric pressure before removing the cone adapter 168. Alternatively, the operator may observe the amount of primary supply fluid 35 removed from the primary fluid supply tank 34 is equal to or substantially equal to the amount of waste fluid 39 collected in the waste tank 36 to determine the bulk of the procedure is complete.

The radiator 50 and overflow bottle 300 may be topped off using the procedure described below and their respective caps 304, 316 replaced completing the procedure. It will be appreciated that the entire procedure may be performed using only the pressure generator 38 and activation of the supply pump 40 is not necessary. In practice, this type of procedure is typically useful for removing approximately 30%–45% of the radiator fluid from the engine cooling system for a quick exchange. Although, if the engine remains at a high enough temperature such that most if not all of the thermostats remain open, then up to approximately 60% of the radiator fluid can be removed and replaced.

Flush Procedure

Referring now to FIG. 17, the following procedure is typically used for a more complete fluid exchange and involves the simultaneous use of the pressure generator 38 and the pump 40. To perform a flush procedure, the suction wand 188 (FIG. 13) is attached to the drain line 156 and the cap 316 of the overflow bottle 300 is removed. Using the suction wand procedure described below, the overflow bottle is drained by the operator. As an option, the radiator cap 304 (FIG. 12) may then be removed by the operator and the suction wand procedure used to reduce the upper level of the fluid in the radiator 50. The radiator cap is replaced and the upper hose influent line 306 and lower hose effluent line 308 are removed from the radiator block. Using conventional coupling techniques, the black service drain line 156 is connected to the radiator at the point where the lower hose effluent line 308 was removed using a suitable adapter. The red service supply line 158 is likewise connected to the radiator block where the upper hose influent line 306 was disconnected. The operator applies hose clamps to pinch off the line 310 going to the overflow bottle 300. The servicing technician may then open both ball valves 162, 163 on each of the servicing hoses 156, 158, respectively. This coupling places the radiator block in a closed loop with the plumbing subsystem of the radiator fluid exchanging apparatus 30.

With reference to FIG. 7, continuing with the flush procedure, on the control panel 224, the operator may then turn the upper dial 256 to the REMOVE FLUID position 258 and the bottom dial 246 to the desired FILL TANK position 250 or 252. In this example, it will be assumed that the auxiliary fluid supply tank 56 has been selected by rotating the bottom dial 246 to the auxiliary fill tank position 252. Rotating the upper dial to the remove fluid position 258 places the inlet 114*c* in communication with outlet port 114*a* of the remove and fill control manifold 42. Rotating the lower dial 246 to the auxiliary fluid supply tank position 252 opens a fluid path between inlet port 115*d* and outlet port 115*c*. This places the auxiliary supply tank 56 in communication with the influent port 307 of the radiator 50.

With this configuration, to begin the fluid flush, the operator depresses the vacuum switch 236 to the ON position 278 (FIG. 15) to actuate the pressure generator to begin creating negative pressure in the waste tank 36. The vacuum created in the waste tank will draw fluid from the radiator 50 through the black service drain line 156 into the waste tank 36 along fluid path 326*a–j*. At the same time or thereafter, the service technician also depresses the pump switch 234 to the ON position by closing the switch 234 against contact 152 to activate the pump to begin drawing fluid from the auxiliary fluid supply tank 56. Once actuated, the supply pump 40 withdraws fluid from the selected fluid supply tank 56 and force the fluid into the radiator through the red service supply line 158 and into the radiator block 50. This fluid path is indicated by directional arrows 328*a–i*. The operator may observe the sight level gauge 216 (FIG. 2) to determine how much fluid from the auxiliary fluid supply tank 56 has been supplied to the radiator and when the desired quantity of auxiliary fluid 37 has been transferred, the operator may switch the pump and vacuum switches 234, 236 to their respective OFF positions 150, 266 to end the flush process. The service lines 156, 158 may then be disconnected and the influent and effluent hoses 306, 308, respectively may be reconnected by the service technician. Optionally, the suction wand procedure described below may be used to remove excess fluid from the radiator 50.

It will further be appreciated that, referring to FIGS. 12 and 17, in addition to forming a servicing loop with the radiator block 50, the effluent hose 308 could be disconnected from the effluent port 46 and the supply service hose 158 could be connected inline with disconnected end of the effluent hose 308 to supply fluid through the entire engine coolant system. The black servicing hose 156 would be coupled to the effluent port 46 of the radiator to receive waste fluid from the radiator block 50 as it is flushed out. In this configuration, the engine coolant in the entire engine cooling system 52 could be replaced. A suitable pump 40, including the pump described above, with a sufficient pressure rating to overcome any closed thermostats to force the thermostats to the open position is preferable in this configuration.

Figure 18:
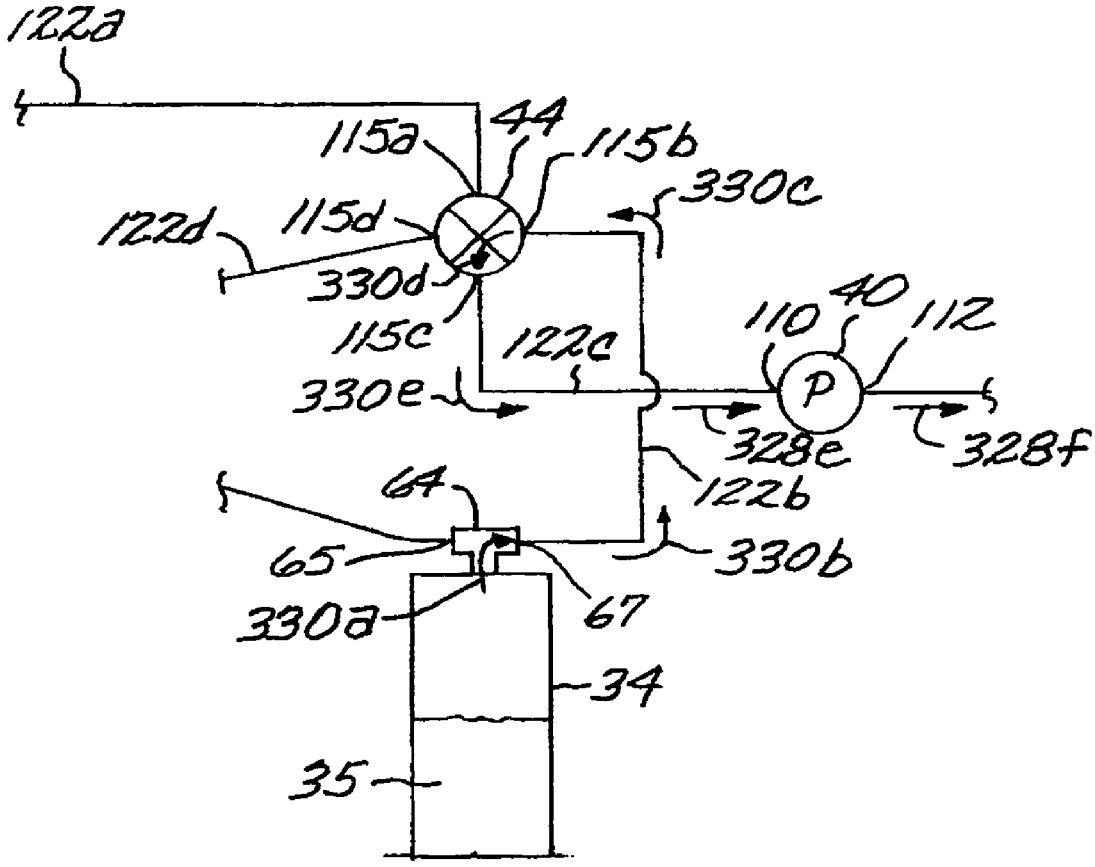
FIG. 18 is a schematic of an exemplary plumbing circuit for performing a flush exchange procedure using an alternative fluid supply source of the radiator fluid exchanging apparatus of FIG. 1.

Referring now to FIGS. 7, 14, and 18, alternatively, the primary fluid supply tank 34 may also supply fluid to the radiator 50 if selected. To select the primary fluid supply tank 34, the service technician would rotate the lower dial 246 to the primary fluid flush tank position 250. By selecting this dial position, a fluid passage is created between inlet port 115*b* with outlet port 115*c* of the flush control manifold 44. This places the primary fluid supply tank 34 in communication with the pump 40 and servicing hose 158 and the radiator influent port 307. Fluid drawn by the pump 40 exits the multi-directional outlet coupling 64 through outlet 67 through conduit 112*b* and into the flush control manifold 44 at inlet port 115*b*. The primary fluid 35 then exits the outlet 115*c* and enters conduit 122*c* and into the pump inlet 110. The fluid is then forced out the pump outlet 112 and into the servicing hose 158 and introduced into the radiator 50 via the influent port 307. This fluid path is indicated by directional arrows 330*a–d* up through the flush control manifold and continues in the direction of arrows 328*d–i* from the manifold 44 to the radiator 50.

Topping Off Procedure

Referring now to FIGS. 7 and 16, for topping off the radiator 50, with the radiator cap 304 (FIG. 12) removed, the operator may connect the wand adapter 188 (FIG. 13) to the red service supply line 158 and ensure the corresponding ball valve 163 is in the closed position. Turning to the control panel 224, the service technician may rotate the lower dial 246 to the fill tank position 250 or 252 to select supply tank 34 or 56 to supply fluid to the radiator. In this example, the primary fluid supply tank 34 is selected by rotating the dial 246 to the fill tank position 250. This creates a pathway from inlet port 115*b* to outlet port 115*c*. The pump switch 236 may be depressed to the ON position 152 by the operator to begin actuation of the supply pump 40 to begin drawing fluid through the outlet 67 of the multi-directional coupling 64 of the selected tank 34 into the conduit 122*b*. The fluid passes through the ports 115*b* and 115*c* of the flush control manifold 44 and into conduit 122*c*. The fluid enters the inlet 110 of the pump 40 and is forced out the outlet 112 and into the supply service line 158. The operator may then open the ball valve 163 to regulate the flow of fluid into the radiator 50. When the desired fluid level is obtained, such as to the fill line in the radiator, the operator may then depress the supply pump switch 236 to the OFF position 150 to terminate the topping off procedure. To complete the procedure, the service technician withdraws the wand adapter 188 from the fill neck 48 of the radiator 50 and replaces the radiator cap 304. A similar process may be used to top off the overflow bottle 300.

Suction Wand Procedure

This procedure allows for a quick fluid removal of the overflow bottle 300 or lower the upper level of the radiator fluid in the radiator 50 once their respective caps 316, 304 are removed. With reference to FIGS. 7, 13, 14, and 17, the operator may connect the wand adapter 188 to the black service drain line 156 and open the associated ball valve 162. The free end 190 of the wand adapter 188 may then be placed into the fill neck 48 of the open radiator or the fill neck 320 of the open overflow bottle. On the control panel 224, the operator may turn the top dial 256 to the REMOVE FLUID position 258. This opens a passageway between the inlet port 114*c* and outlet port 114*a*. The service technician may then depress the vacuum switch 236 to the Vacuum position 278 to withdraw fluid into the drain line 158 along fluid path 326*a–j* and into the waste tank 36. The vacuum switch 236 is turned off by the operator when the desired amount of fluid has been removed. To complete the procedure, the service technician removes the wand adapter 188 from the fill neck of the fluid reservoir being serviced and replaces the associated cap.

Pressure Test

Referring now to FIGS. 7, 14, and 16, yet another procedure that may be accomplished using this servicing apparatus 30 is a pressure test on the radiator cap which is typically manufactured to a predetermined pressure release rating. Initially the operator removes the upper radiator hose 306 (influent line) from the inlet port 307 of the radiator 50. The red service hose 158 is coupled to the cone adapter 168 (FIG. 10) which is in turn connected to inlet port 307 using conventional techniques. During this procedure, the radiator cap 304 is on. The black service line 156 is not connected to the radiator block 50. The ball valves 162, 163 on both service hoses 156, 158, respectively, are initially turned to the closed position by the operator. The overflow tube 310 to the overflow bottle is placed in an unclamped state. Turning to the control panel 224, the operator rotates the top dial 256 to the PRESSURE TEST position 264 to create a passageway between inlet port 114*d* to outlet port 144*c* placing the auxiliary supply fluid tank 56 in fluid communication with the pressure gauge 136 via conduits 120*d* and 120*c*.

The service operator then rotates the bottom dial 246 to the desired fluid fill tank position 250 or 252 to select the corresponding fluid supply tank 34 or 56. In this example, the auxiliary fluid supply tank 56 has been selected by rotating the lower dial 246 to the left fill tank position 252. This creates a passage between inlet port 115*d* and outlet port 115*c* in the flush control manifold 44. The pump switch 236 is then depressed to the On position 152 by the operator to activate the supply pump 40 to begin drawing auxiliary fluid 37 from the auxiliary fluid supply tank 56 through the outlet 80 of the multi-directional coupling 76 and into conduit 122*d*. The fluid continues through the inlet port 115*d* and outlet port 115*c* of the flush control manifold 44 and into conduit 122*c* to enter the pump 40 at pump inlet 110. The auxiliary fluid 37 is then forced out the pump outlet 112 and into the red service supply line 158. The ball valve 163 of the red service line 158 is then slowly opened by the operator. Fluid will initially flow along the fluid path indicted by directional arrows 340*a–j*.

As the fluid has nowhere to go, once any remaining air pockets are filled in the radiator a backpressure will build up. In reaction to this backpressure, in addition to fluid moving through conduit 122*d* toward the pump 40, fluid will also flow through conduit 120*d* through the passageway between inlet port 114*d* and 114*c* of the remove and fill control manifold 42 and into conduit 120*c* along the fluid path as indicated by directional arrows 330*a–e* (FIG. 20) where the fluid pressure may be read off the pressure gauge 136. Once the desired pressure reading matching the specifications of the radiator cap 304 is observed, the service technician may depress the pump switch 234 to the OFF position 150 to prevent additional pressure build-up. The system pressure may then be bled using conventional techniques by the service operator.

Alternatively, the overflow valve (not shown) of the radiator cap 304 may be triggered and fluid released into the overflow bottle 300 through unclamped overflow line 310. The pressure gauge 136 reading at the time of the pressure release by the valve may be recorded by the service technician and the radiator cap replaced if necessary. As radiator caps are manufactured to release overflow pressure at a predetermined pressure rating, this process of pressurizing the system until the radiator overflow valve is actuated to allow fluid to pass through the overflow line 310 and into the overflow bottle 300 may be used to test the radiator cap valve. It will be appreciated that the servicing technician may refer to a service manual for reference pressures for the radiator cap being tested. Prior to disconnecting the red service line 158 from the radiator 50, the pressure is relieved from the system by the service technician. The upper influent line 306 is then reconnected to the radiator inlet port 307.

Drain Tanks Procedure

Referring now to FIGS. 7, 14–15, and 20, it will be appreciated that both supply tanks 34, 56 and the waste collection tank 36 can be drained using the radiator fluid exchanging apparatus 30. For example, to drain the waste fluid 39 from the waste collection tank 36, the service technician connects the wand adapter 188 (FIG. 13) to the quick disconnect 186 of the red servicing supply hose 158. The free end 190 of the wand adapter is then placed within a waste collection tank 106 and the ball valve 164 rotated to an open position. With the servicing hose 158 connected to the waste collection tank 106 and ball valve 164 in the open position, the service technician may then drain the waste fluid 39 from the waste tank 36 by rotating the lower dial 246 to indicate the DRAIN WASTE position 254 on the control panel 224. This creates a throughway between inlet port 115*a* to 115*c* in flush control manifold 44 placing the outlet 104 of the multi-directional coupling 100 of the waste tank 36 in communication with the inlet 110 of the pump 40 via conduits 122*a*, the flush control manifold 44, and conduit 122*c* and in further communication with the waste collection tank 106 through conduit 158 and wand adapter 188.

On the control panel 224, the operator may then depress the vacuum switch 234 to the upper drain position 288. This activates the pump 40 to initiate suction of the waste fluid 39 collected in the waste tank 36 out of outlet 104 and into fluid circuit 122*a*. The waste fluid 39 then enters the inlet port 115*a* and passes through the flush control manifold 44 and exits the outlet port 115*c* and into conduit 122*c*. Passing through the inlet 110 of the activated pump 40, the waste fluid 39 is forced out of the pump outlet 112 and enters the red service line 156 and continues on out the free end 190 of the adapter 188 and into the waste collection tank 106. The fluid follows the path designated by directional arrows 332*a–h* (FIG. 20). Once the fluid level in the waste tank 36 reaches a low limit threshold, the low fluid level switch 90 inside the waste tank 36 will transmit a low fluid signal to the main board 74 of the control panel 224 which then transmits a signal via wire lead 140 to shut off the pump 40 and automatically terminate the drain waste tank procedure. Thus, the service technician can switch the vacuum switch 234 to "DRAIN" position and walk away.

With continued reference to FIGS. 7, 14–15 and 20, the primary and auxiliary fluid supply tanks 34 and 56, respectively, may also be drained as follows. Initially, the open end adapter 188 (FIG. 13) is connected to the red service line 158 and placed in the waste collection receptacle 106. To drain the primary fluid 35 from the primary fluid supply tank 34, the operator turns the lower dial 246 on the control panel 224 to the flush right side tank position 250. This creates a throughway between inlet port 115*b* and outlet port 115*c* in the flush control manifold 44.

The operator may then depress the pump switch 236 to the ON position 152 (FIG. 15) to actuate the pump 40 to begin drawing primary fluid 35 from the primary fluid supply tank 34 out of the outlet 67 of coupling 64 through conduit 122*b* and through the manifold 44 and into conduit 122*c* picking up the fluid path at 332*d*. The primary fluid 35 then passes through the pump 40 and out the red service line 158 and into the storage receptacle 106 to drain the tank 34 along fluid path indicated by directional arrows 328*e–h*. The service technician may then depress the pump switch 234 to the OFF position 150 and the pump 40 may be turned off when the volume of fluid in the selected tank is low as visually observable through the right sight gauge 214 (FIG. 2) or the NEW FLUID TANK LOW LED 240 illuminates on the control panel 224 (FIGS. 7 and 15) as the low level sensor 72 is triggered and sends a signal to the main board 74 via wire lead 124 (FIG. 15).

To drain the auxiliary fluid 37 from the auxiliary fluid supply tank 56, the operator turns the 246 dial to the flush left side tank position 252 instead of to the flush right side tank position 250. This creates a fluid passageway between inlet port 115*d* and 115*c* in the flush control manifold 44. The operator may then depress the pump switch 236 to the ON position 152 (FIG. 15) to actuate the pump 40 to begin drawing auxiliary fluid 37 from the auxiliary fluid supply tank 56 out of the outlet 80 of coupling 76 and into conduit 122*d*. The auxiliary fluid 37 then passes through the manifold 44 and, picks up the fluid path at 332*d*. After passing through the pump 40, the auxiliary fluid continues out the red service line 158 and into the storage receptacle 106 to drain the tank 56 along fluid path indicated by directional arrows 332*e–h*. The service technician may then depress the pump switch 234 to the OFF position 150 and the pump 40 may be turned off when the volume of fluid in the selected tank is low as visually observable through the left sight gauge 214 or the NEW FLUID TANK LOW LED 240 illuminates on the control panel 224 as the low level sensor 84 is triggered and sends a signal to the main board 74 via wire lead 126.

While the present invention has been described in terms of a number of preferred embodiments for performing radiator fluid servicing procedures on a vehicle, various changes and improvements may also be made to the invention without departing from the scope and spirit thereof.

What is claimed is:

1. A radiator fluid exchanging apparatus for servicing an engine coolant system having a radiator with an influent port and an effluent port, said apparatus comprising:

a first fluid supply tank for supplying a supply fluid and having a multi-directional supply coupling defining first and second supply outlets in communication with a suction inlet disposed within said first fluid supply tank;

a pressure vessel for collecting a waste fluid and including a waste fluid coupling in communication with an interior of said pressure vessel and defining a waste fluid collection inlet and a waste fluid exhaust;

a pressure generator coupled to said pressure vessel and being operable to selectively direct said waste fluid into said pressure vessel through said waste fluid collection inlet under a negative pressure;

a remove and fill control manifold coupled to said pressure vessel and said first fluid supply tank and including a remove and replacement port for coupling to said effluent radiator port, said remove and fill control manifold including a waste fluid collection pathway for routing said waste fluid entering said remove and fill control manifold from said effluent radiator port, when coupled thereto, to said waste fluid collection inlet, and further defining a fluid replacement pathway for routing said supply fluid entering said remove and fill control manifold from one of said supply outlets of said first fluid supply tank to said effluent port of said radiator, when coupled thereto, said remove and fill control manifold being selectively operable to direct said waste fluid through said waste fluid collection pathway or said supply fluid through said fluid replacement pathway under said negative pressure;

a flush control manifold coupled to said first fluid supply tank and said pressure vessel, said flush control manifold including a fluid supply pathway between one of said supply outlets and a pump exhaust outlet and further defining a drain pathway for routing said collected waste fluid exiting said waste fluid exhaust to said pump exhaust outlet, said flush control manifold being selectively operable to route said supply fluid through said fluid supply pathway or said collected waste fluid through said drain pathway; and a pump including a fluid receiving inlet coupled to said pump exhaust outlet of said flush control manifold and further including a fluid directing outlet for coupling to said influent port of said radiator, said pump being selectively operable to direct said supply fluid from said first fluid supply tank into said fluid receiving inlet and out of said fluid directing outlet when said flush control manifold is selectively positioned to open said fluid supply pathway.

2. The radiator fluid exchanging apparatus as set forth in claim 1 further including:

a fluid removal and replacement conduit including a first end coupled to said remove and replacement port and a free end for coupling to said effluent port of said radiator.

3. The radiator fluid exchanging apparatus as set forth in claim 2 further including:

a fluid supply conduit including a first end coupled to said fluid directing outlet of said pump and a free end for coupling to said influent port of said radiator.

4. The radiator fluid exchanging apparatus as set forth in claim 3 wherein:

said free ends of said fluid removal and replacement conduit and said fluid supply conduit include a quick disconnect and a ball valve for opening and closing the fluid passage therethrough.

5. The radiator fluid exchanging apparatus as set forth in claim 3 further including:

an elongated auxiliary adapter including a first end with first adapter port coupled to the free end of said removal and replacement conduit and a second adapter port coupled to the free end of the fluid supply conduit said adapter, the second end of said auxiliary adapter including corresponding first and second exhaust ports, said auxiliary adapter further including at least one selectively operable valve for routing a fluid from exiting said adapter ports to said corresponding exhaust ports, or routing fluid exiting one adapter port into the other said adapter port, or routing fluid exiting one adapter port to the exhaust port corresponding to the other of said adapter ports.

6. The radiator fluid exchanging apparatus as set forth in claim 2 wherein:

said free end of said fluid removal and replacement conduit is coupled to a cone adapter having a seal with a throughbore for inserting into a fill neck of said radiator.

7. The radiator fluid exchanging apparatus as set forth in claim 2 wherein:

said free end of said fluid removal and replacement conduit is coupled to an open ended wand adapter for suctioning off fluid from said radiator.

8. The radiator fluid exchanging apparatus as set forth in claim 1 further including:

a fluid supply conduit including a first end coupled to said fluid directing outlet of said pump and a free end for coupling to said influent port of said radiator.

9. The radiator fluid exchanging apparatus as set forth in claim 8 wherein:

said free end of said fluid supply conduit is coupled to an open ended wand adapter for supplying fluid to the influent port of said radiator.

10. The radiator fluid exchanging apparatus as set forth in claim 1 further including:

an auxiliary fluid supply tank for supplying an alternative fluid to said radiator and having a multi-directional coupling with first and second auxiliary fluid supply outlets in communication with an auxiliary suction tube inlet disposed within said auxiliary fluid supply tank, at least one of said auxiliary fluid supply outlets being in communication with at least one of said manifolds.

11. The radiator fluid exchanging apparatus as set forth in claim 10 wherein:

one of said auxiliary fluid supply outlets is in communication with said flush control manifold; and said flush control manifold includes an auxiliary fluid supply pathway for selectively placing said auxiliary fluid supply tank in communication with said fluid receiving inlet of said pump.

12. The radiator fluid exchanging apparatus as set forth in claim 10 further including:

a wheeled cabinet enclosing said primary and auxiliary fluid supply tanks, said pressure vessel, said pump, and said manifolds.

13. The radiator fluid exchanging apparatus as set forth in claim 10 wherein:

one of said auxiliary fluid supply outlets is in communication with said remove and fill control manifold; and said remove and fill control manifold defines a third fluid pathway for selectively placing said auxiliary fluid supply tank in communication with said remove and replacement port.

14. The radiator fluid exchanging apparatus as set forth in claim 1 further including:

a low level fluid sensor in said first fluid supply tank proximate a bottom surface of said primary fluid supply tank for generating a low supply fluid level signal;

an upper fluid level sensor in said pressure vessel proximate an upper surface of said pressure vessel for generating a high waste fluid level signal;

a lower fluid level sensor in said pressure vessel proximate a bottom surface of said pressure vessel for generating a low waste fluid level signal; and a main board in electrical communication with each of said sensors and programmed to generate a status indicator corresponding to said fluid level signal received from at least one of said sensors.

15. The radiator fluid exchanging apparatus as set forth in claim 14 further including:

an auxiliary fluid supply tank for supplying an alternative fluid to said radiator and having a multi-directional coupling with first and second auxiliary fluid supply outlets in communication with an auxiliary suction tube inlet disposed within said auxiliary fluid supply tank, at least one of said auxiliary fluid supply outlets being in communication with said flush control manifold; and a low level auxiliary fluid sensor in said auxiliary fluid supply tank proximate a bottom of said auxiliary tank for generating a low auxiliary fluid level signal, said lower auxiliary low level fluid sensor being in electrical communication with said main board.

16. The radiator fluid exchanging apparatus as set forth in claim 14 further including:

a delay circuit in electrical communication with said upper fluid level sensor in said pressure vessel and said main board, said main board being responsive to shut off said pressure generator upon receiving a signal from said delay circuit after a predetermined time period.

17. The radiator fluid exchanging apparatus as set forth in claim 16 wherein:

said delay circuit includes an adjustable capacitor element for adjusting said predetermined time period.

18. The radiator fluid exchanging apparatus as set forth in claim 17 wherein:

said capacitor element is responsive to the turning of a set screw in communication therewith to adjust said predetermined time period.

19. The radiator fluid exchanging apparatus as set forth in claim 16 wherein:

said predetermined time period is from approximately 7–11 seconds.

20. The radiator fluid exchanging apparatus as set forth in claim 1 wherein:

said control manifolds are ball valves constructed to selectively route fluid between at least two fluid pathways.

21. The radiator fluid exchanging apparatus as set forth in claim 1 further including:

a pressure gauge in fluid communication with said remove and fill control manifold for sensing fluid pressure issuing from said remove and replacement port.

* * * * *